United States Patent [19]

Hisatsune et al.

[11] Patent Number: 4,866,226

[45] Date of Patent: Sep. 12, 1989

[54] MULTI-PHASE CIRCUIT BREAKER EMPLOYING ARC EXTINGUISHING APPARATUS

[75] Inventors: Fumiyuki Hisatsune; Hiroshi Fujii; Shinji Yamagata; Yoshiaki Kobayashi, all of Hiroshima, Japan

[73] Assignee: Mitsubishi Denki Kabushiki Kaisha, Tokyo, Japan

[21] Appl. No.: 217,445

[22] Filed: Jul. 11, 1988

[30] Foreign Application Priority Data

Jul. 13, 1987 [JP] Japan ..... 62-175259
Jul. 13, 1987 [JP] Japan ..... 62-175257
Jul. 13, 1987 [JP] Japan ..... 62-175258

[51] Int. Cl.[4] ..... H01H 33/18
[52] U.S. Cl. ..... 200/147 B; 200/144 R
[58] Field of Search ..... 200/144 R, 147 R, 147 B

[56] References Cited

U.S. PATENT DOCUMENTS 1,919,438 7/1933 Lindstrom ..... 200/147 B
2,596,865 5/1952 Peter ..... 200/147 B

FOREIGN PATENT DOCUMENTS 52-71051 5/1977 Japan .

*Primary Examiner*—Robert S. Macon
*Attorney, Agent, or Firm*—Burns, Doane, Swecker & Mathis

[57] ABSTRACT

In a circuit breaker, an arc is produced between a pair of switchable contact members when these contact members are opened due to overcurrent. An arc extinguishing apparatus is employed to extinguish an arc produced between the opened contact members. The arc extinguishing apparatus includes a plurality of U-shaped metal arc extinguishing plates which are stacked, and a pair of insulating plates made of a synthetic resin. These insulating plates are mounted on both inside surfaces of leg portions of the extinguishing plates.

40 Claims, 17 Drawing Sheets

MULTI-PHASE CIRCUIT BREAKER EMPLOYING ARC EXTINGUISHING APPARATUS

BACKGROUND OF THE INVENTION

1. Field of the Invention

The present invention generally relates to a circuit breaker. More specifically, the invention is directed to an arc extinguishing, or shooting apparatus for contacts of a multi-pole circuit interrupting apparatus (circuit breaker).

2. Description of the Related Art

In general, circuit breakers including arc extinguishing apparatuses for contacts have been widely used to electrically interrupt power source lines when overcurrent flows through the power source lines. One of these conventional circuit breakers having arc extinguishing, or shooting apparatuses is described in, for instance, Japanese KOKAI (Disclosure) Utility Model Application No. 52-71051 opened on May 27, 1977 filed by Mitsubishi DENKI K.K.

Referring now to FIGS. 1 and 2, this conventional circuit breaker having the conventional arc extinguishing apparatus will be described.

FIG. 1 is a fragmentary sectional side view of one pole (single phase) of the conventional circuit breaker including the conventional arc extinguishing apparatus and FIG. 2 is a plan view of the arc extinguishing apparatus of FIG. 1. Referring to FIG. 2, reference numeral 1 denotes a case for the circuit breaker, 101 denotes its side wall, 2 denotes a movable contact member coupled with a movable contact controller (not shown), 201 denotes its movable contact, 3 denotes a fixed contact member, and 301 denotes its fixed contact. Reference numeral 4 denotes the conventional arc extinguishing apparatus for extinguishing an arc formed between the contacts 201 and 301 at the time when the circuit current flowing through these contacts 201 and 301 is interrupted, 5 denotes an external conductor, 6 denotes an external connection terminal for connecting the external conductor 5 to the fixed contact member 3, 601 denotes a screw for attaching the external connection terminal 6 to the fixed contact member 3, and 602 denotes a screw for securely clamping the external conductor 5 to the external connection terminal 6. Reference numeral 7 denotes an insulating partition disposed between the arc extinguishing apparatus 4 and the external connection terminal 6, and 8 denotes an arc runner disposed on the fixed contact member 3.

The conventional arc extinguishing apparatus 4 is constructed of a plurality of substantially U-formed arc extinguishing plates 401 opening on the side of the movable and fixed contact members 2, 3 held by side support plates 402 in a stacked condition in the vertical direction (viewed in FIG. 1) spaced apart from one another, and having two leg portions 403 of each arc extinguishing plate 401. Reference numeral 9 denotes an insulating plate made of inorganic material such as mica and asbestos which is disposed on both inside surfaces of the two leg portions 403.

Operation will be briefly described below. When a higher current such as an overcurrent flows through the movable and fixed contacts 201, 301 also closed, the movable contact member 2 is separated from the fixed contact member 3 by means of the movable contact controller, whereby the contacts 201, 301 are opened and an arc is formed between these contacts 201, 301. At that time, the arc is driven and expanded in the direction of the inner portion 405, or base, of the arc extinguishing plate 401, i.e., toward the right in FIG. 2, by electromagnetic action between the magnetic flux produced through the arc extinguishing plate 401 due to the arc current (the magnetic flux produced by eddy current) and the arc current itself, so that the arc is divided into sections and cooled down by the arc extinguishing plates 401 so as to be extinguished. The function of the insulating plate 9, in such an arc extinguishing process, is to prevent the arc extinguishing plate 401 from being melted under the heat of the arc and from being, further, scattered. Besides, as suggested in the above-mentioned Japanese KOKAI (Disclosure) Utility Model Application No. 52-71051 (1977). the insulating plate 9 serves the function to prevent the arc from jumping from the end or side of the movable contact 201 or the movable contact member 2 to the leg portions 403 of the arc extinguishing plate 401 and stagnating there to make the interruption of the current unachievable.

However, since the insulating plate 9 is formed of an inorganic material, the surface of the insulating plate 9 goes into a melted condition under the higher heat of the arc during the circuit breaking operation. As a result, while the arc current is at the zero-cross point, the insulation recovery capability between the movable and fixed contacts will be deteriorated thereby making the current interruption impossible. There are also such problems with the prior art insulating plates that they are not mass-producible, higher in manufacturing cost, brittle due to their high hardness, easily broken by vibrational shocks, and further, easily affected by heat shocks, for example, cracks are formed on the surface of the insulating plate 9 while serving subjected to the arc.

The present invention has been made in view of these conventional drawbacks, and therefore, an object of the present invention is to provide an arc extinguishing apparatus including insulating plates not causing inability of current interruption, mass-producible at low cost, hardly broken by vibrational shocks, and further, resistive to heat shocks from the arc.

Another object of the present invention is to provide a circuit interrupting apparatus including an arc extinguishing apparatus having various advantages as described above.

SUMMARY OF THE INVENTION

These objects of the present invention and other features thereof are accomplished by providing an arc extinguishing apparatus (1000) used for extinguishing an arc produced between a pair of switchable contact members (2;3) of a circuit interrupting apparatus, comprising:

a plurality of arc extinguishing plates (401A;401B;401C) made of a metal material, each arc extinguishing plate being constructed of one base portion (405;406) and two leg portions (403) positioned opposite to each other, and said plurality of arc extinguishing plates being stacked up at a predetermined interval; and, a pair of insulating plates (9A) made of a synthetic resin, positioned on both inside surfaces of the leg portions (403) of the respective stacked arc extinguishing plates (401A;401B;401C) so as to define a space where said paired switchable contact members (2;3) of the circuit interrupting apparatus are located.

Furthermore, according to the present invention, an arc extinguishing apparatus (7000) used for extinguishing an arc produced between a pair of switchable contact members (2;3) of a circuit interrupting apparatus, comprising:

a plurality of arc extinguishing plates (401H;401J;401K) made of a metal material, each arc extinguishing plate being constructed of one base portion (405;406) and two leg portions (403H;403I;403K;403J) positioned opposite to each other, and said plurality of arc extinguishing plates being stacked up at a predetermined interval; and, one insulating plate (9A) made of a synthetic resin, positioned on both inside surface of the leg portions (403H;403I;403K;403J) of the respective stacked arc extinguishing plates (401H;401J;401K) so as to define a space where said paired switchable contact members (2;3) of the circuit interrupting apparatus are located.

Furthermore, according to the present invention, a circuit interrupting apparatus (9000) comprising:

at least first, second, and third poles located in parallel with each other, each pole being constructed of a pair of switchable contact members (2L;3L,2I;-3I,2R;3R) and said second pole being located between said first and third poles; and, at least first, second, and third arc extinguishing apparatus (7000L;7000I;7000R) mounted on said corresponding first, second, and third poles, for extinguishing an arc between said pair of switchable contact members (2L;3L,2I;3I,2R;3R) of each pole, said first and third arc extinguishing apparatus (7000L;7000R) each including:

a plurality of arc extinguishing plates (401H;401J;401K) made of a metal material, each arc extinguishing plate being constructed of one base portion (405;406) and two leg portions (403H;403I) positioned opposite to each other, and said plurality of arc extinguishing plates being stacked up at a predetermined interval; and, one insulating plate (9A) made of a synthetic resin, positioned on an inside surface of one of said leg portions (403H;403I) of the respective stacked arc extinguishing plates (401H;401J;401K) so as to define a space where said paired switchable contact members (2;3) of the circuit interrupting apparatus (9000) are located, and also said second arc extinguishing apparatus (7000I) positioned between said first and third arc extinguishing apparatus (7000L;7000R), including:

a plurality of arc extinguishing plates (401A) made of a metal material, each arc extinguishing plate being constructed of one base portion (405) and two leg portions (403) positioned opposite to each other, and said plurality of arc extinguishing plates (401A) being stacked up at a predetermined interval; and, a pair of insulating plates (9A) made of a synthetic resin, positioned on both inside surfaces of the leg portions (403) of the respective stacked arc extinguishing plates (401A) so as to define a space where said paired switchable contact members (2;3) of the circuit interrupting apparatus (9000) are located.

BRIEF DESCRIPTION OF THE DRAWINGS

For a better understanding of the present invention, reference is made to the specification in conjunction with the accompanying drawings, in which.

DETAILED DESCRIPTION OF THE PREFERRED EMBODIMENTS

First Arc Extinguishing Apparatus

First, a construction of an arc extinguishing (shooting) apparatus 1000 according to a first preferred embodiment of the present invention will now be described with reference to FIGS. 3 through 6.

Figure 3:
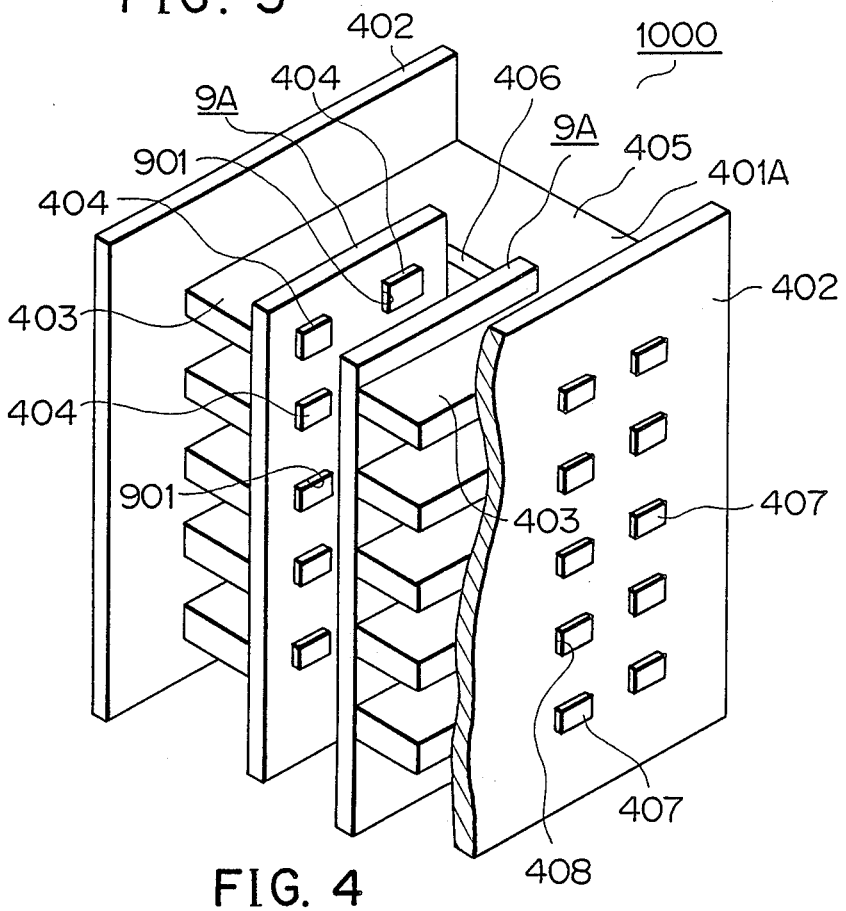
FIG. 3 is a perspective view of an arc extinguishing apparatus 1000 according to a first preferred embodiment of the invention.
Figure 4:
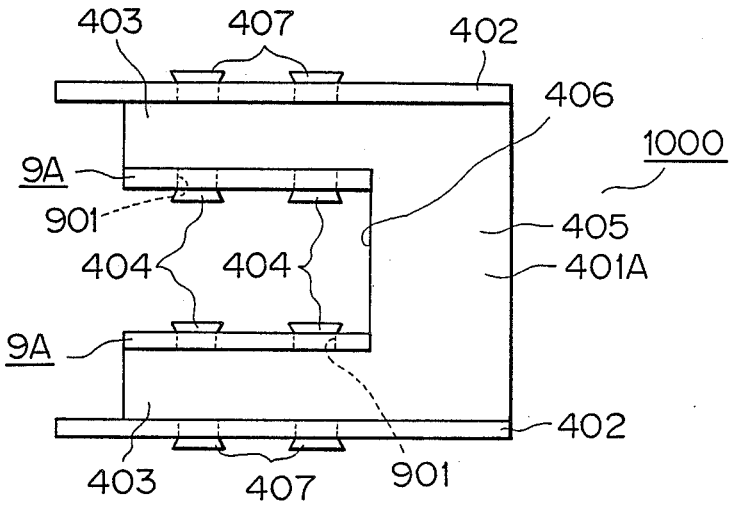
FIG. 4 is a front view of the arc extinguishing apparatus 1000 shown in FIG. 3.
Figure 5:
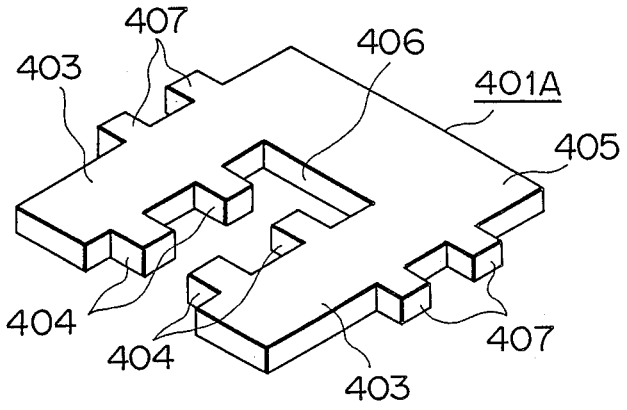
FIG. 5 is a perspective view of the arc extinguishing plate of the arc extinguishing apparatus 1000.
Figure 6:
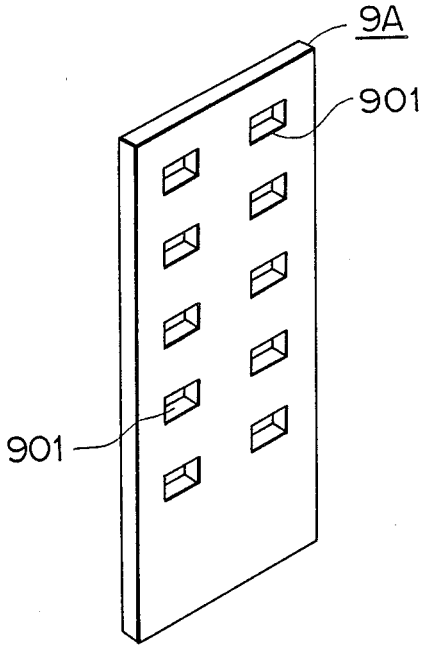
FIG. 6 is a perspective view of the insulating plate of the arc extinguishing apparatus 1000.

FIG. 3 is a perspective view with a portion broken away of the arc extinguishing apparatus 1000, FIG. 4 is a plan view of the arc extinguishing apparatus 1000 of FIG. 3, FIG. 5 is a perspective view of an arc extinguishing plate, and FIG. 6 is a perspective view of an insulating plate, wherein like or corresponding component parts to those in the prior art apparatus are denoted by corresponding reference numerals.

As illustrated in FIGS. 3 through 6, the arc extinguishing apparatus 1000 of the first embodiment is constructed of five substantially U-formed arc extinguishing plates 401A opening on the side of movable and fixed contact members 2, 3, held by side support plates 402 in a stacked condition in the vertical direction in FIG. 3 spaced apart from one another. Reference numerals 403 denote two leg portions of each arc extinguishing plate 401A. Reference numeral 9A denotes an insulating plate (will be discussed later) made of a resin material and two thereof are disposed on the inside surfaces of the two leg portions 403.

More specifically, there are shown an arc extinguishing plate 401A corresponding to the plate 401 of the prior art and an insulating plate 9A corresponding to the plate 9 of the prior art. The insulating plate 9A according to the present invention, however, is made of a synthetic resin material. The two leg portions 403 of each arc extinguishing plate 401A are provided with projections 404 projecting inwardly (as viewed in FIG. 4), whereas the insulating plate 9A is provided with holes 901 made therein corresponding to all of the projections 404. The insulating plate 9A is securely supported on the inside surfaces of the two leg portions 403 by inserting the projections 404 into the holes 901 in the insulating plate 9A and then caulking the projections 404 therein. Reference numeral 405 indicates the base portion of the U-formed arc extinguishing plate 401A and its interior edge 406 remains exposed so that it may cool the arc coming into contact therewith. Reference numerals 407 denote projections provided outwardly for the leg portion 403 of the arc extinguishing plate 401A, and by inserting the projections 407 into holes 408 made in the side support plates 402 and then caulking the projections 407 therein, the arc extinguishing plate 401A is adapted to be supported by the side support plates 402.

Functions of Insulating Plate

By virtue of the disposing of the insulating plates 9A on the inside surfaces of the two leg portions 403 of the arc extinguishing plate 401A in the manner described above, the arc is prevented or restrained from jumping to the arc extinguishing plate 401A, which is surrounded by the insulating plate 9A. Here, a particular feature of employment of such an insulating plate 9A of the present invention will be summarized. Since the insulating plate 9A is formed of a synthetic resin material, its surface never melts down. The surface resistance of the insulating plate 9A becomes high during the current interrupting operation. It contributes to a good interrupting performance. Since better formability of this insulating plate can be expected, it is mass-producible at low cost. It is resistive to heat shocks.

In addition, by forming the insulating plate 9A of a synthetic resin material, the present invention has the following particular features. That is, as the temperature of the synthetic resin material of the insulating plate 9A is increased, vapor gas is produced. However, the arc is deprived of some of its energy by the production of the vapor gas and the arc is cooled by the produced vapor gas. Further, the rise in pressure on the surface of the insulating plate 9A due to production of the vapor gas moves the arc into the base portion 405 of the arc extinguishing plate 401A, whereby the current interrupting performance is improved. In other words, since the insulating plate 9A is positioned close to the movable and fixed contacts 201, 301 which function as the source of the arc discharge, vapor gas is produced by the arc formed near the surface of the insulating plate 9A, whereby the pressure near the surface thereof is increased.

Further, the rise in the pressure by production of the vapor gas causes the contact opening speed of the movable and fixed contact members 2, 3 to be increased and this also contributes to the improvement in the current interrupting performance. This is because a large quantity of vapor gas is produced from the insulating plate 9A positioned near the movable and fixed contacts 201, 301 of the contact members 2, 3, and the pressure at locations far from the source of the arc discharge, i.e., these contacts, becomes considerably lower than that around the arc discharging source. This pressure difference increases the contact opening speed of the contact members 2, 3.

The features of the present invention described above in detail have specific effects that are not obtained from those of the prior art made of inorganic materials producing no vapor gas. Although it may sometimes happen that dust of insulating material is produced from the insulating plate 9A rubbed by the arc extinguishing plate 401A when put into a vibrating condition and the dust comes between the movable and fixed contacts 201, 301 leading to an insufficient contact between these contacts 201, 301 when they are closed. However, by virtue of the arrangement of the insulating plate 9A being held by all the arc extinguishing plates 401A as made in the first embodiment, it becomes difficult for the insulating plate 9A and the arc extinguishing plate 401A to rub against each other even when put into a vibrating condition and therefore the insufficient contact between the movable and fixed contacts 201, 301 does not occur.

Circuit Interrupting Apparatus Employing First Arc Extinguishing Apparatus

An example of application of the above described arc extinguishing apparatus 1000 according to the first preferred embodiment to a circuit interrupting apparatus (circuit breaker) 2000 will now be described below with reference to FIG. 7.

Figure 7:
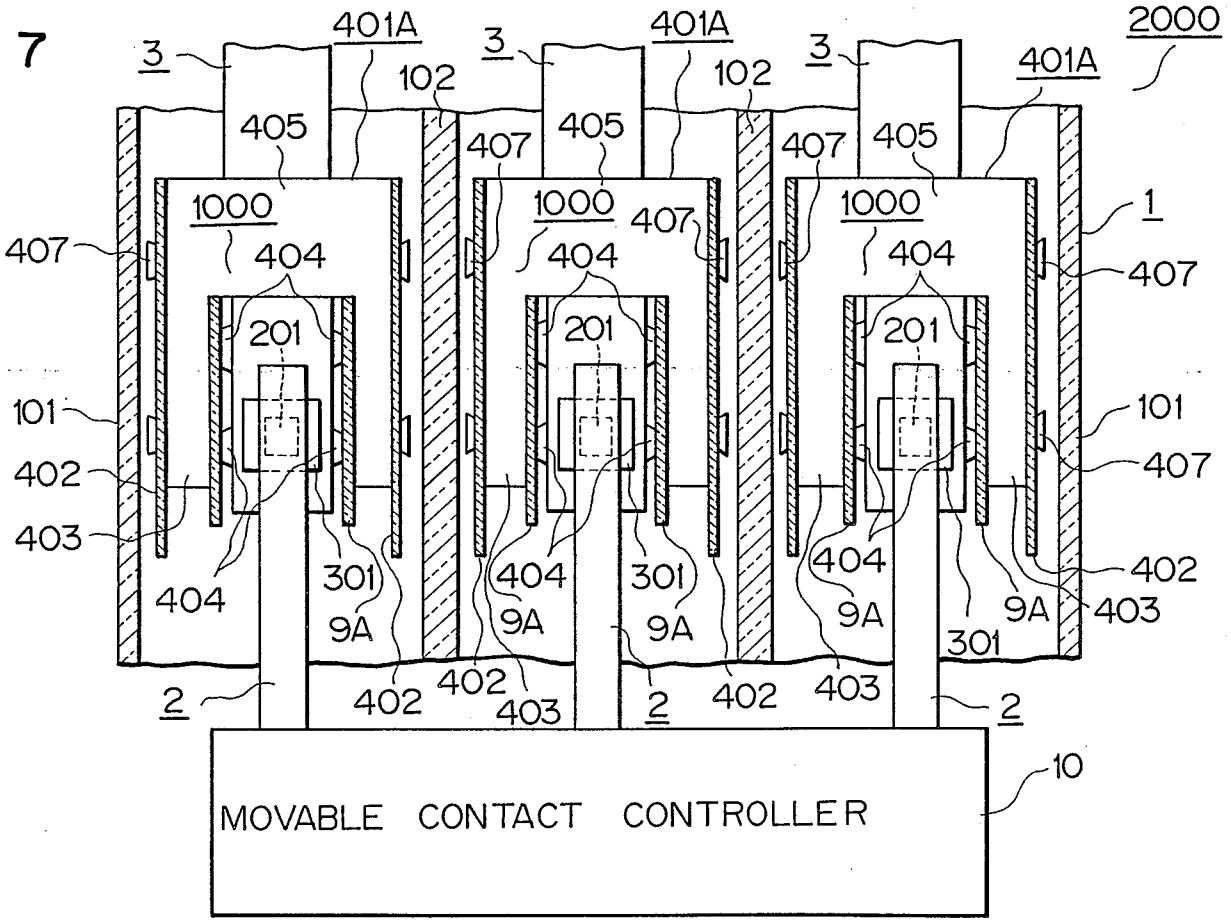
FIG. 7 is a cross-sectional view of a three-phase circuit interrupting apparatus 2000 employing the arc extinguishing apparatus 1000.

FIG. 7 shows a longitudinal sectional-view of a three-pole circuit breaker 2000 employing the arc extinguishing apparatus 1000 of the first embodiment. A detailed description of the construction of the circuit breaker 2000 will be given later.

First, the construction of the three-phase circuit breaker 2000 of FIG. 7 will be described briefly. The movable contact member 2 coupled with a movable contact controller 10 has a movable contact 201 fixed to its end. A fixed contact 301 is disposed at the position confronting the movable contact 201 (which is not observable from FIG. 7). The arc extinguishing apparatus 1000 according to the first preferred embodiment is disposed in such a manner as to surround the contacts 201, 301 as shown in FIG. 7. That is, one arc extinguishing apparatus 1000 is provided with one pair of contacts 201, 301 for one phase of the three phases. By employment of such arc extinguishing apparatus 1000, the above-described specific advantages can be obtained.

Second Arc Extinguishing Apparatus

Figure 8:
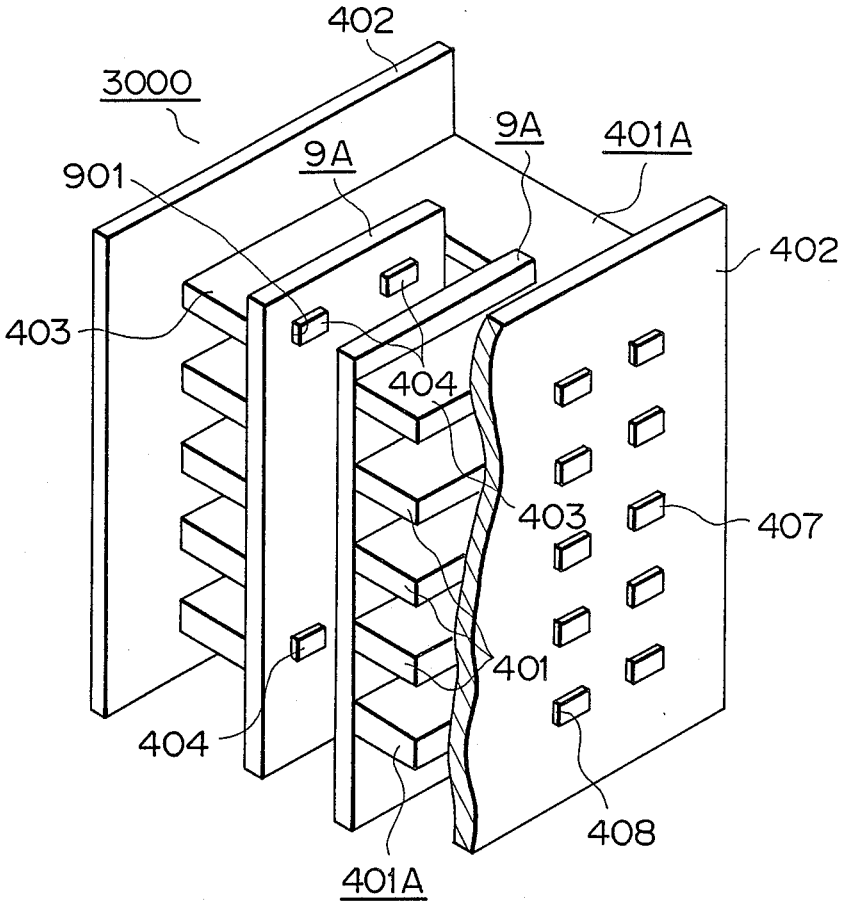
FIG. 8 is a perspective view of an arc extinguishing apparatus 3000 according to a second preferred embodiment.

An arc extinguishing apparatus 3000 according to a second preferred embodiment is shown in FIG. 8.

A difference between the first embodiment and this second embodiment as shown in FIGS. 3 through 6 is that the projections 404 are only provided on the uppermost and the lowermost arc extinguishing plates 401A of the five and the intermediate three arc extinguishing plates 401A are provided with no projection. As a result, the insulating plate 9A has holes 901 only at the positions corresponding to the projections 404 formed on the uppermost and lowermost plates. The projections 404 of the topmost and the bottommost arc extinguishing plates 401A are inserted into these holes 901 and then the projections 404 are caulked therein. Since no projection 404 is formed in the central portion of the insulating plate 9A of the second embodiment, it has an advantage over the first embodiment of FIGS. 3 through 6 that the arc is more difficult to jump over the intermediate arc extinguishing plates 401A.

Third Arc Extinguishing Apparatus

An arc extinguishing apparatus 4000 according to a third preferred embodiment will be described with reference to FIGS. 9 and 10.

Figure 9:
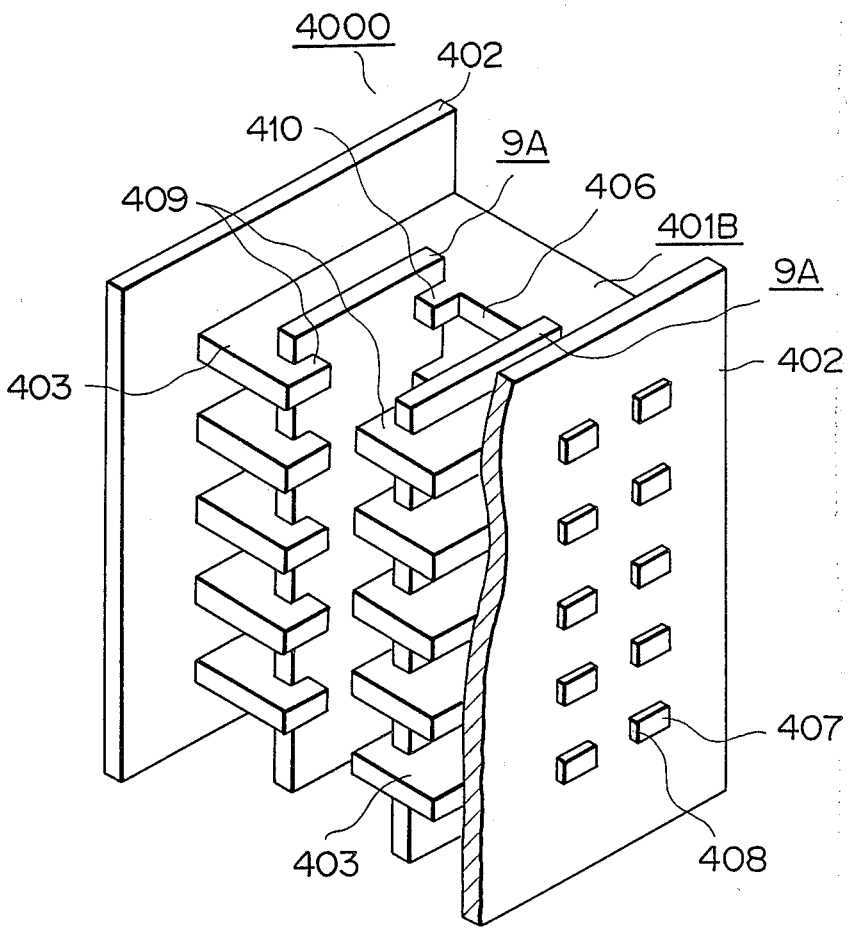
FIG. 9 is a perspective view of an arc extinguishing apparatus 4000 according to a third preferred embodiment.
Figure 10:
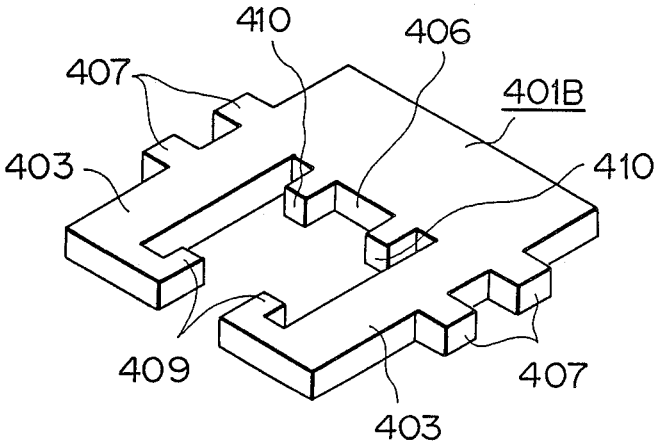
FIG. 10 is a perspective view of the arc extinguishing plate of the arc extinguishing apparatus 4000.

FIG. 9 is a perspective view of an arc extinguishing apparatus 4000 and FIG. 10 is a perspective view of an insulating plate thereof. Referring to the FIGS. 9 and 10, reference numeral 401B denotes an arc extinguishing plate. Each arc extinguishing plate 401B is provided inwardly with first holding portions 409 at the end of each leg portion 403 forming a space of a predetermined width between the respective holding portions and the leg portion. The arc extinguishing plate 401B is also provided inwardly with second holding portions 410 at the base 406 forming a space of the predetermined width between the respective holding portions and the two leg portions. Accordingly, the insulating plates 9A can be inserted between the two leg portions 403 and the first and second holding portions 409, 410 and thereafter these holding portions 409, 410 are caulked so that the insulating plates 9A are fixed to the arc extinguishing plate 401B. The third preferred embodiment has an advantage over the first preferred embodiment in that no holes 901 are needed to be made in the insulating plate 9A. Although the insulating plate 9A in the present third embodiment is arranged to be supported by all of the arc extinguishing plates 401B in conjunction with the first and second holding portions 409, 410, the insulating plate 9A may be supported only by, for instance, the topmost and the bottommost arc extinguishing plates 401A as same as in the second embodiment of FIG. 8.

Fourth Arc Extinguishing Apparatus

Figure 11:
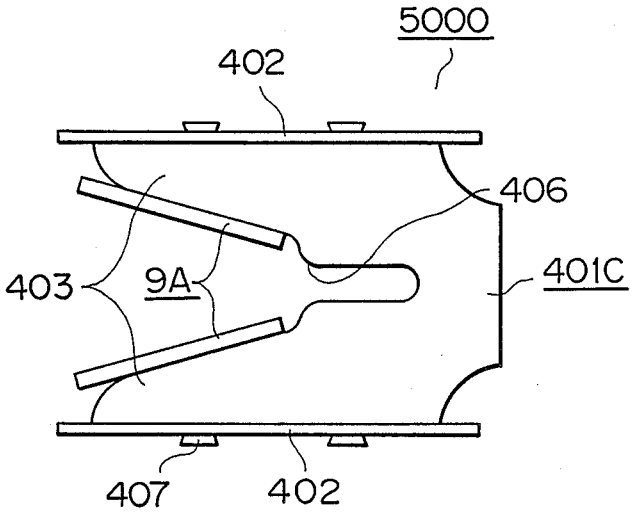
FIG. 11 is a front view of an arc extinguishing apparatus 5000 according to a fourth preferred embodiment.

A plan view of a portion of an arc extinguishing apparatus 5000 according to a fourth preferred embodiment is shown in FIG. 11. Referring to FIG. 11, reference numeral 401C denotes ar. arc extinguishing plate. The present arc extinguishing plate 401C is different from the arc extinguishing plates 401A, 401B in the above described first to three embodiments in that it has two leg portions 403 inner edges thereof are arranged to be oblique by some degree but similar to them in that it is shaped substantially in a V-form. The arc extinguishing plate 401C of such a shape is known inthe art. In the present fourth embodiment, the insulating plate 9A is adhered to the inside surfaces of the two leg portions 403 of the arc extinguishing plate 401C with a suitable adhesive agent. Therefore, the two leg portions 403 of the arc extinguishing plate 401C are electronically insulated substantially completely from the arc by way of the insulating plate 9A. As a result, the arc is prevented from jumping to the two leg portions 403 practically completely. It should be noted that even in the case of an insulating plate of the shape as shown in FIG. 4, the insulating plate 9A may of course be fixed by adhesion to the two leg portions 403 as same as in this fourth preferred embodiment.

Materials of Insulating Plate

Materials of the insulating plate 9A will be described more in detail. While the insulating plate 9A according to the present invention as described above is formed of a synthetic resin material, synthetic resin materials are generally classified into thermoplastic resins and thermosetting, or thermoset resins. When particular advantages of thermoplastic resins and thermosetting resins are compared with respect to those obtainable from the first embodiment of FIGS. 3 through 6, it is found that, generally, the thermoplastic resins are superior to the thermosetting resins in formability, resistivity to vibration and shocks, and resistivity to heat shocks, but the thermosetting resins are superior to the thermoplastic resins in surface resistance. There is practically no difference between the both types in the quantity of produced vapor gas. Further, in points of being light in weight, producing little dust by rubbing, if any, with the insulating plate under vibration and shocks, and having a good moisture resistance, the thermoplastic resins are superior to the thermosetting resins. Whereas in points of having high heat distortion temperature and exhibiting small thermal expansion, the thermosetting resins are superior to the other type. More concretely, as the thermoplastic resin materials suitable for making the insulating plate 9A, a polyester resin can be employed. As the suitable thermosetting resin materials, epoxy resin and phenol resin can be employed other than silicone resin and polyester resin. the silicone resin has, in addition to the general characteristics as mentioned above, such a characteristic that it precipitates practically no carbon on the surface of the insulating plate 9A even if it has been exposed to the arc and produced the vapor gas. It therefore has an advantage that it does not cause any such problem as insufficient insulation after current interruption or insulation deterioration and in this point this resin is superior to other resin materials.

In the case where polyester resin or phenol resin is used, mechanical strength can be improved by mixing glass fibers therein. As the structure of the insulating plate 9A, ordinary molding and fiber sheet can be considered. Even if formed of the same synthetic resin material, such a fiber sheet product has particular advantages over that of the ordinary resin molding such as that the fiber sheet produces a larger quantity of vapor gas, provides better shaping processability, and is easier for punching.

Multi-Pole Circuit Interrupting Apparatus

A multi-pole (multi-phase) circuit interrupting apparatus 6000 according to a fifth preferred embodiment employing the aforesaid arc extinguishing apparatus 1000 as the first embodiment will be described below with reference to FIG. 12.

As described above, the insulating plate 9A formed of a synthetic resin material produces vapor gas under heat of the arc, and as a result, the interior pressure of the circuit interrupting apparatus 6000 sharply rises. Generally, in a multi-pole circuit interrupting apparatus having three poles or above (a three-phase circuit interrupting apparatus is exemplified in the present embodiment), the inter-pole pressures at the intermediate pole arranged between two poles of both sides are well balanced, even if the pressure therein is suddenly increased, by virtue of other poles present at its both sides. As for the poles on both sides, since the pressure outside the case 1 of the interrupting apparatus 6000 is atmospheric pressure, a great pressure difference is sometimes developed between interior and exterior of the side wall 101 of the case 1 of the interrupting apparatus 6000. On account of development of such a great pressure difference, there is a risk of breakage of the case 1 of the interrupting apparatus 6000 itself. It should be noted that each pole of the circuit interrupting apparatus 6000 has a pair of movable and fixed contact members 2 and 3.

Figure 12:
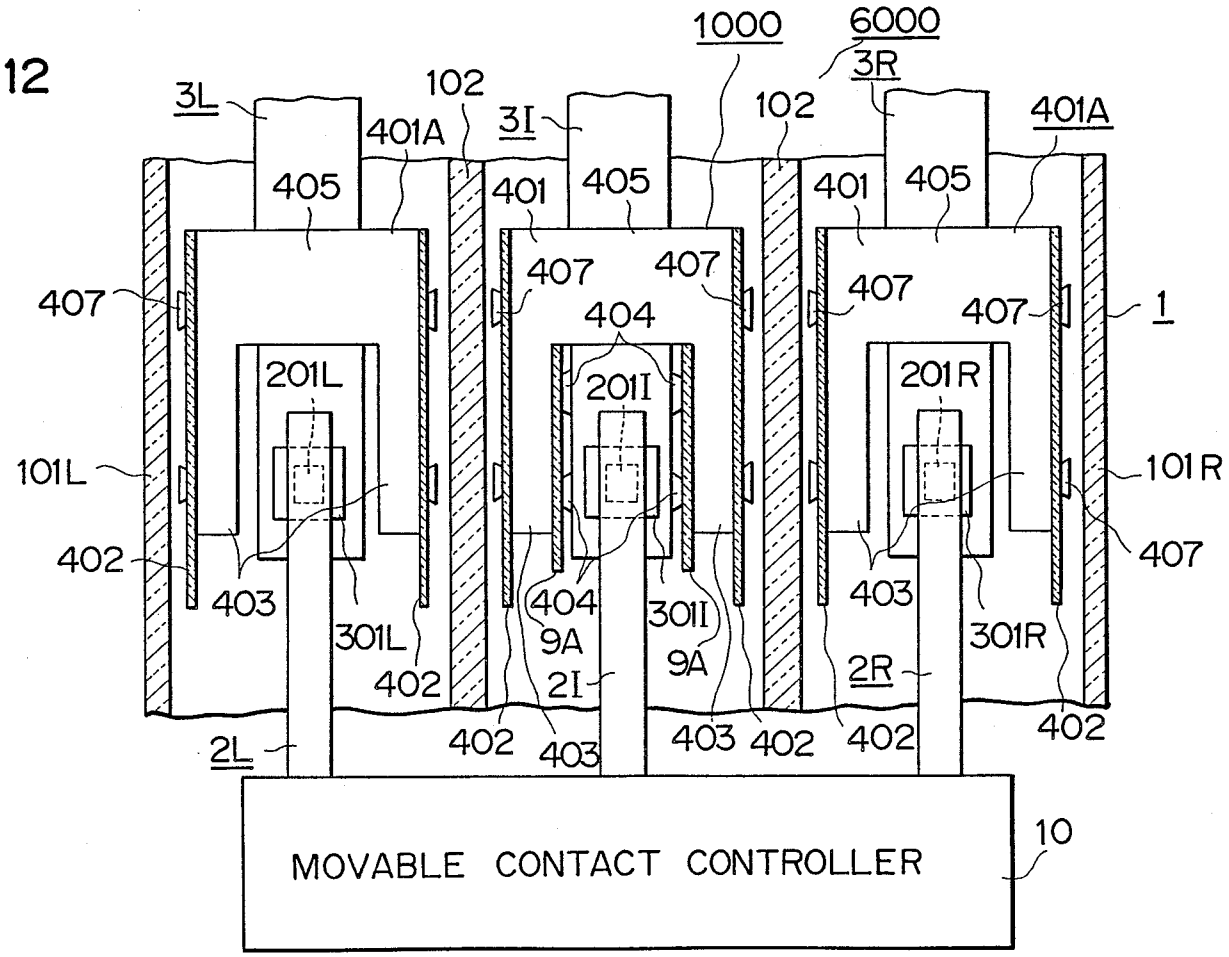
FIG. 12 is a cross-sectional view of a multi-pole circuit interrupting apparatus 6000 employing the arc extinguishing apparatus 1000, according to a fifth preferred embodiment.

To eliminate the risk as aforesaid, in the preferred embodiment as shown in FIG. 12, no arc extinguishing apparatuses 1000 is provided for the movable contacts 201R, 201L and the corresponding fixed contacts 301R, 301L for the poles disposed on both left and right sides of the figure. However, for the movable contact 201I and the fixed contact 301I of the intermediate pole, the arc extinguishing apparatus 1000 is disposed in a given place.

With the circuit interrupting apparatus 6000 of the above-described construction, when an overcurrent flows between the movable contact 201I and the fixed contact 301I, the movable contact controller 10 is energized so that the movable contact 201I is separated from the fixed contact 301I. An arc is formed when the corresponding contacts are opened. By the arc, a vapor gas is generated from the insulating plate 9A of the arc extinguishing apparatus 1000, and then, the internal pressure of the circuit interrupting apparatus 6000 is raised. According to the circuit interrupting apparatus 6000 of the preferred embodiment, there is no risk of the breakage of the partition 102 due to pressure difference between the intermediate pole and the left-hand and right-hand poles. Also, since no arc extinguishing apparatuses 1000 are installed for the contacts 201L, 301L and 201R, 301R of the left-hand and right-hand poles, no great pressure difference is produced between the pressure in the contact area and atmospheric pressure separated by a left-hand or right-hand side wall 101L, 101R which is thinner than the aforesaid partition 102. Consequently, the risk of the breakage of the case 1 of the circuit interrupting apparatus 6000 can be eliminated.

Modifications

Now, modifications of the above-described fifth embodiment will be described.

It is apparent that the circuit interrupting apparatus 6000 of the fifth embodiment may be provided the contacts 201I and 301I of the intermediate pole not only with the arc extinguishing apparatus 1000, but also with another type, such as the arc extinguishing apparatus 3000, 4000, and 5000 as shown in FIGS. 8–11.

It is also apparent that various synthetic resin materials may be used for the material of the insulating plate 9A the same as in the above described embodiments.

Although a three-pole circuit interrupting apparatus 6000 was shown in the above fifth embodiment of FIG. 12, the present invention may be applied widely to a multi-pole circuit interrupting apparatus having more than three poles, such as a four-pole circuit interrupting apparatus including one neutral pole (grounded pole) and a six-pole circuit interrupting apparatus in which two sets of three-pole circuit interrupting apparatuses are installed in parallel. For example, in case of a four-pole circuit interrupting apparatus, there are provided two intermediate poles, and in case of a six-pole circuit interrupting apparatus, there are provided four intermediate poles, and therefore, satisfactory results are obtained by disposing the insulating plates of synthetic resin material on the inner surfaces of the two leg portions of the arc extinguishing plates only for the arc extinguishing apparatuses for such intermediate poles.

According to the present invention as described above, only by such a simple construction as to dispose insulating plates made of a synthetic resin material on the inner surfaces of the two leg portions of the arc insulating plate only for the arc extinguishing apparatuses for the intermediate poles, it has become possible to provide multi-pole circuit interrupting apparatuses for three poles or above exhibiting better current interrupting performance than those employing the prior art insulating plates made of an inorganic material, and causing no serious damage on the case of the circuit interrupting apparatus even if vapor gas is produced from the insulating plate made of such a synthetic resin material when exposed to heat of the arc.

Sixth Arc Extinguishing Apparatus

Referring now to FIGS. 13 to 16, an arc extinguishing apparatus according to a sixth preferred embodiment enabled to suppress the rise in pressure due to production of the vapor gas from the insulating plate of the circuit interrupting apparatus will now be described.

Figure 13:
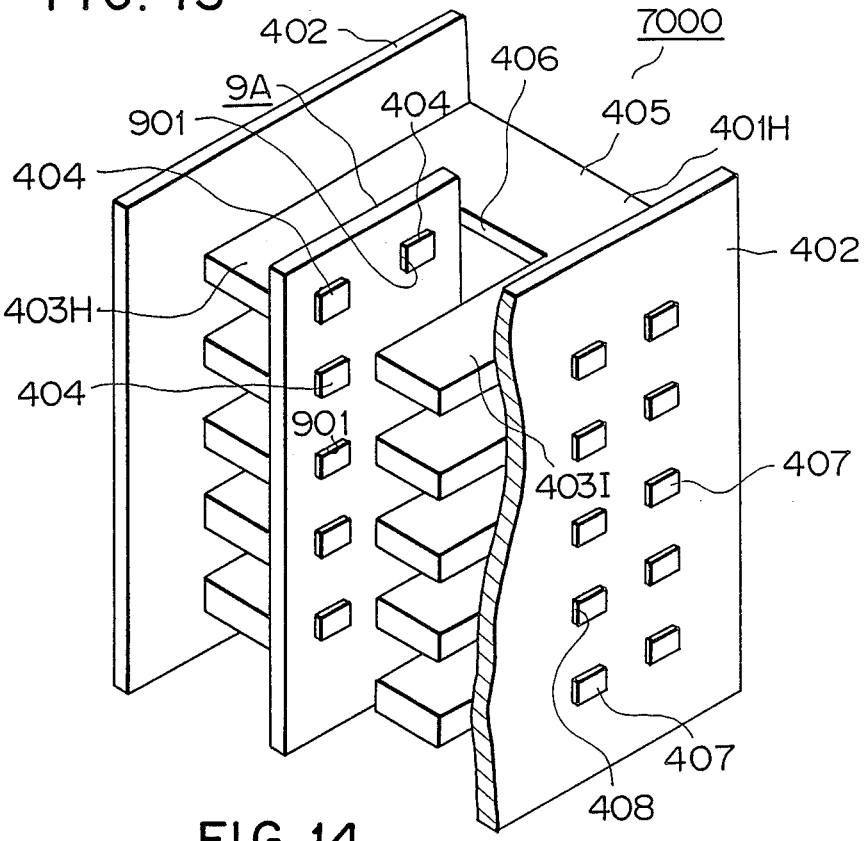
FIG. 13 is a perspective view of an arc extinguishing apparatus 7000 according to a sixth preferred embodiment of the invention.
Figure 14:
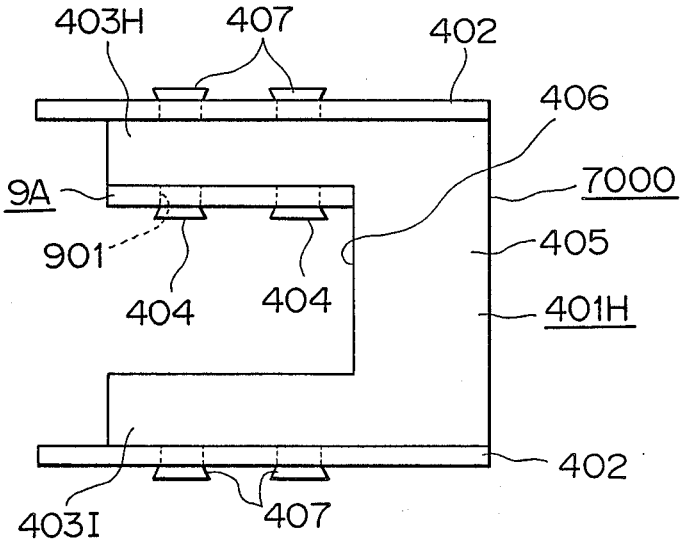
FIGS. 14 to 16 illustrate the arc extinguishing plate and insulating plate of the arc extinguishing apparatus 7000.
Figure 15:
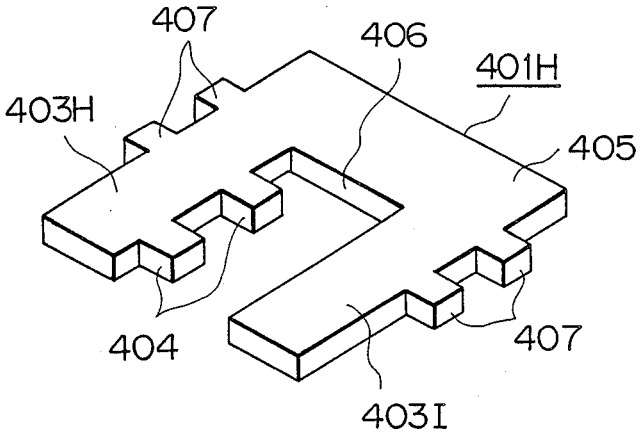
Figure 16:
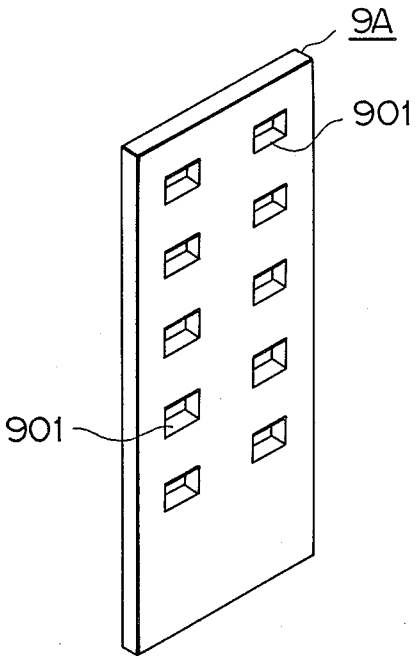

FIG. 13 is a perspective view with a portion broken away of an arc extinguishing apparatus 7000 according to the present example, FIG. 14 is a plan view of the arc extinguishing apparatus of FIG. 13, FIG. 15 is a perspective view of an arc extinguishing plate, and FIG. 16 is a perspective view of an insulating plate, wherein corresponding parts to those in the first embodiment will be denoted by corresponding reference numerals and description thereof will be omitted.

Referring to the figures, reference numeral 401H denotes an arc extinguishing plate, 403H and 403I denote the two leg portions of the arc extinguishing plate 401H, and 9A denotes an insulating plate. In the present sixth embodiment, the insulating plate 9A made of a synthetic resin material is disposed on the inner surface of only one leg portion (the leg portion 403H in the present embodiment) of the respective arc extinguishing plates 401H. The one leg 403H of each arc extinguishing plate 401H for which the insulating plate 9A is to be attached, is provided with projections 404 inwardly projecting therefrom, while the insulating plate 9A is provided with holes 901 made therein corresponding to all of the projections 404. In addition, the insulating plate 9A is fixedly supported on the inner surface of the leg portion 403H by inserting the projections 404 into the holes 901 in the insulating plate 9A and then by caulking the projections 404 therein. Reference numeral 405 shows the base portion of the arc extinguishing plate 401H, and the interior edge 406 thereof is left exposed for cooling the arc coming in contact therewith. Reference numerals 407 denote projections provided for both leg portions 403H, 403I of the respective arc extinguishing plates 401H projecting outwardly therefrom. These projections 407 are inserted into holes 408 made in side support plates 402 and then caulked so that the arc extinguishing plates 401H are supported by the side support plates 402.

By employing such an insulating plate 9A on the inner surface of one leg portion 403H of the respective arc extinguishing plates 401H, the arc is prevented or restrained from jumping to the leg portion 403H of the arc extinguishing plate 401H. Since the insulating plate 9A is made of a synthetic resin material, its surface will not be melt, but maintains high surface resistance of the insulating plate 9A while interrupting the contact current, provides a good interrupting performance, and can be mass-produced at low cost because of its good formability, and resistive to heat shocks.

While the other leg portion 403I of the arc extinguishing plate 401H may sometimes come into contact with the arc, there is the insulating plate 9A on the opposite leg portion 403H allowing no arc to be stagnant there, so that the arc is induced from the portion of the insulating plate 9A into the base portion 406 of the arc extinguishing plate 401H and never stagnates along the leg portion 403I.

Advantages of Single Insulating Plate

Further, by forming the insulating plate 9A of a synthetic resin material, the following particular effects can be obtained. That is, as the temperature of the synthetic resin material of the insulating plate 9A is increased, the vapor gas is produced, so that the arc energy is deprived to some extent by the production of the vapor gas and the arc is cooled by the produced vapor gas. Further, the rise in pressure on the surface of the insulating plate 9A due to production of the vapor gas moves the arc into the base portion of the arc extinguishing plate 401H, and the rise in the pressure by production of the vapor gas also increases the pole opening speed of the contact members 2, 3. As a consequence, combined with the fact that the arc does not become stagnant as aforesaid, the present arrangement exhibits, although the insulating plate 9A is provided only for one leg portion 403H of the respective arc extinguishing plates 401H, even better interrupting performance than those having the prior art insulating plates made of an inorganic material disposed on the inner surface of both of the leg portions 403H, 403I. Further, since there is used only one insulating plate 9A, even if the internal pressure is raised by the production of the vapor gas therefrom, it does not become so high as to cause serious damage on the side wall of the circuit interrupting apparatus. Although it sometimes occurs that dust of insulating material is produced from the insulating plate 9A rubbed by the arc extinguishing plates 401H when put into a vibrating condition and the dust comes between the contacts 201, 301 leading to a worse contact between these contacts 201, 301 when the contacts are closed, but by virtue of the arrangement made in the present embodiment to have the insulating plate 9A held by all of the arc extinguishing plates 401A, it becomes difficult for the insulating plate 9A and the arc extinguishing plate 401H to rub against each other and therefore the worse, or insufficient contact between the contacts 201, 301 does not occur.

Positionally Shifted Contact Member of Circuit Breaker

A circuit interrupting apparatus 7500 employing the above-described arc extinguishing apparatus 7000 will be described below with reference to FIG. 17. The characteristic point of the circuit interrupting apparatus 7500 of the present example, in brief, is that the position of the fixed contact member is positionally shifted from the center line (longitudinal axis as viewed in FIG. 17) of the arc extinguishing plate.

Figure 1:
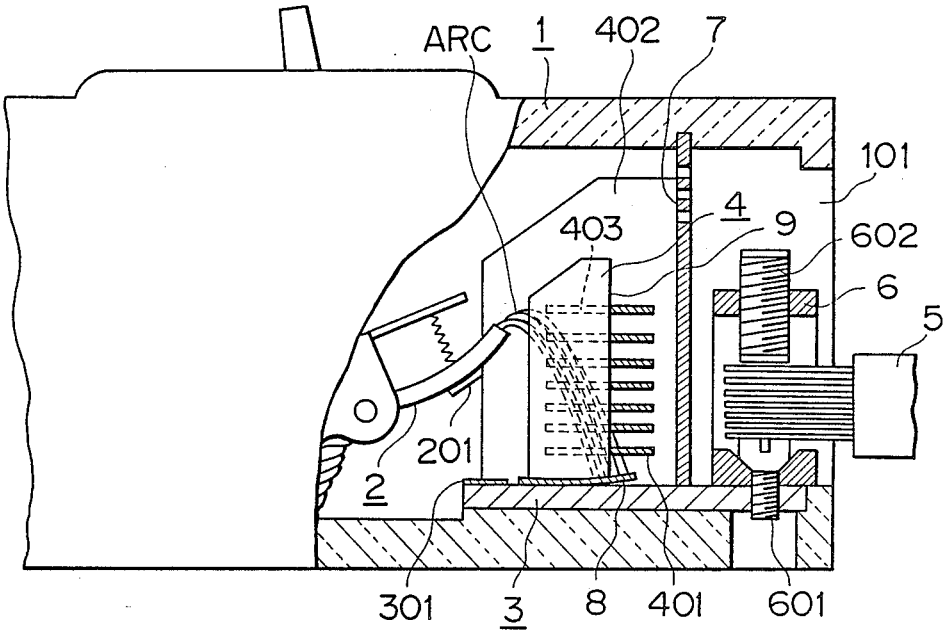
FIG. 1 PRIOR ART
FIG. 1 is a fragmentary sectional view of the conventional circuit breaker employing the prior art arc extinguishing apparatus.
Figure 2:
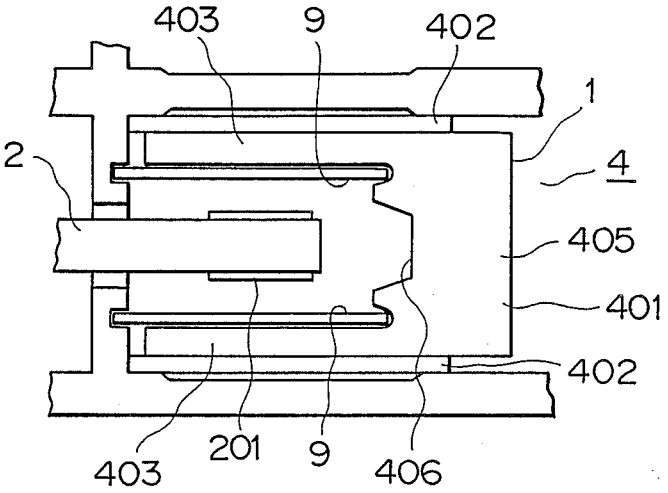
FIG. 2 PRIOR ART
FIG. 2 is a front view of the arc extinguishing apparatus shown in FIG. 1.
Figure 17:
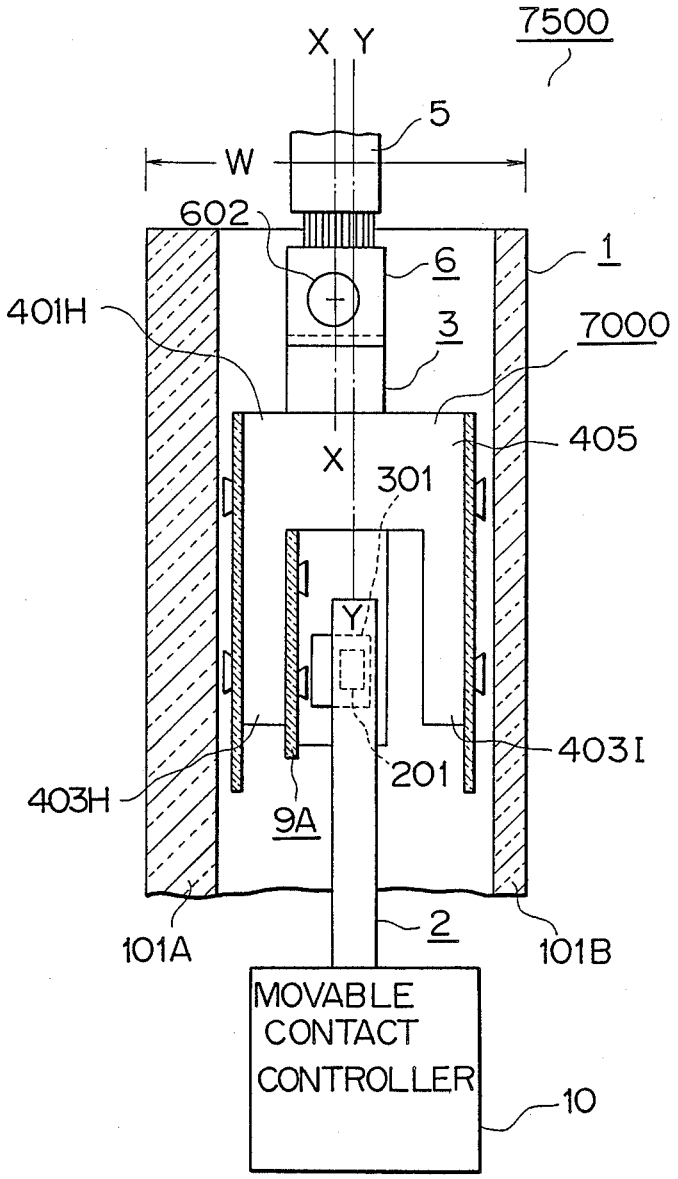
FIG. 17 is a fragmentary cross-sectional view of a circuit interrupting apparatus 7500 according to a seventh preferred embodiment.

That is, the circuit interrupting apparatus 7500 as a seventh preferred embodiment is shown in a fragmentary cross-sectional plan view of FIG. 17. Referring to the figure, reference numerals 101A, 101B denote side walls of the case 1 of the circuit interrupting apparatus 7500 and 10 denotes a movable contact controller for the movable contact member 2. In the present embodiment, the center line X—X of the fixed contact member 3 is positionally shifted to the left in FIG. 17 from the center line Y—Y of the arc extinguishing plate 401H of the arc extinguishing apparatus 7000, and only one insulating plate 9A is disposed on the inner surface of the insulating plate leg portion 403H located closer to the fixed contact member 3. That is, since the leg portion 403H closer to the fixed contact member 3 is liable to come in contact with the arc, it is designed such that this leg portion 403H may be preferentially protected therefrom by way of the insulating plate **9*a*. The reason why the center line X—X of the fixed contact member 3 is horizontally shifted to the left in the illustrated case from the center line Y—Y of the arc extinguishing plate 401H is as follows. In fixing the external connection terminal 6 to the case 1 of the circuit interrupting apparatus 7500 with a screw 601 (FIG. 1) or clamping the external conductor 5 to the external connection terminal 6 with a screw 602, the fixed contact member 3 tends to rotate in a clockwise direction around the center of the screw 601 and at that time it sometimes occurs that the fixed contact member 3 hits on the side wall 101A to damage it. In order to prevent that, it is sometimes practiced to increase the wall thickness of the side wall 101A without changing the external size of the circuit interrupting apparatus, specifically the width W. In such a case, the fixed contact member 3 must be located in general at a certain position to be determined by the location of the external conductor 5. Hence, the arc extinguishing apparatus 7000 and movable contact member 2 inevitably come to a position shifted to the right with respect to the fixed contact member 3, and as a result, the center line X—X of the fixed contact member 3** must be positionally shifted to the left from the center line Y—Y of the arc extinguishing plate H.

Further, it sometimes becomes necessary for some reason or other to exchange an existing circuit interrupting apparatus 7500 of the present example which has been installed on a switchboard (not shown) with another circuit interrupting apparatus. also in such a case, the center line X—X may be shifted to the left or right of the center line Y—Y. Furthermore, for a certain reason, the center line of the movable contact member 2 may be shifted to the left or right of the center line Y—Y of the arc extinguishing plate 401. In any case, it is preferable to dispose the insulating plate 9A on the inner surface of one leg portion 403H or the other leg portion 403I, whichever located closer to the movable contact member 2 or the fixed contact member 3.

Modification of Sixth Arc Extinguishing Apparatus

According to the present invention, the arc extinguishing apparatus 7000 according to the sixth embodiment as shown in FIGS. 13 through 16 may be modified in various ways.

Figure 18:
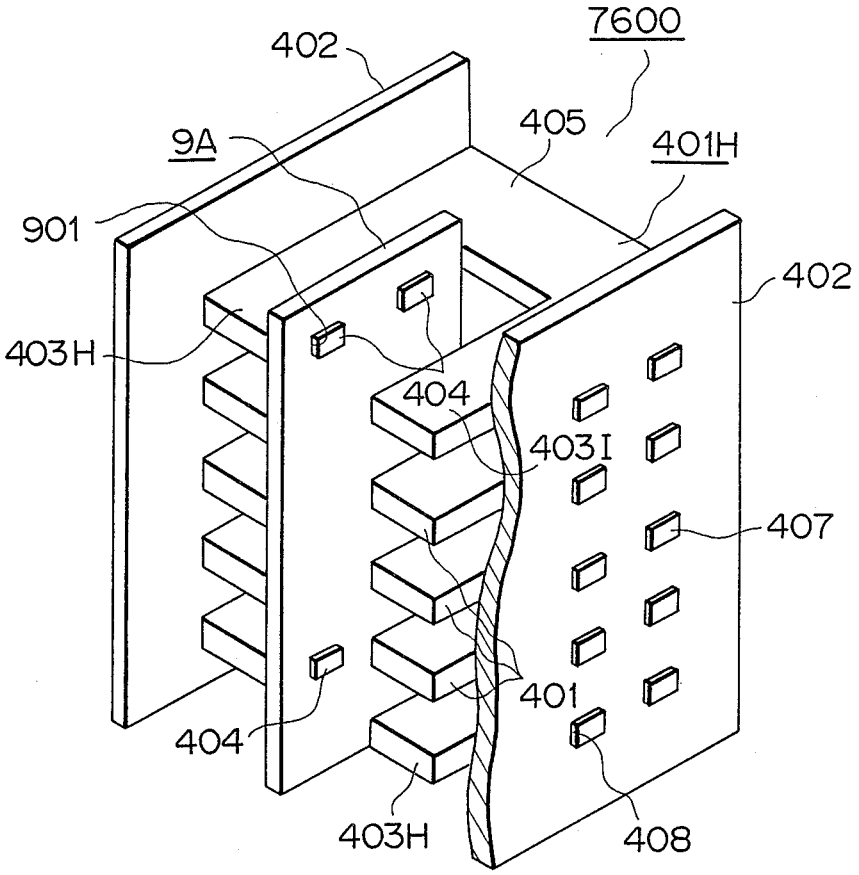
FIG. 18 is a perspective view of an arc extinguishing apparatus 7600 according to an eighth preferred embodiment.

An eighth preferred embodiment of the present invention is, for instance, shown in FIG. 18. A structure of an arc extinguishing apparatus 7600 according to this eighth preferred embodiment is different from the arc extinguishing apparatus 7000 of the sixth embodiment shown in FIGS. 13 through 16 in that the projections 404 are provided only on the topmost and the bottommost arc extinguishing plate 401H, and the intermediate arc extinguishing plates 401 are not provided with any projection. Therefore, the insulating plate 9A is provided with holes made therein only at positions corresponding to the projections 404. The projections 404 of the topmost and the bottommost arc extinguishing plates 401H are inserted into the corresponding holes 901 and then the projections 404 are caulked therein. The present embodiment is particularly advantageous in that, since it has no projections 404 in the central portion of the insulating plate 9A, the arc is more difficult to jump to the intermediate arc extinguishing plates 401 than in the arc extinguishing apparatus 7000 of the sixth embodiment shown in FIGS. 13–16.

Figure 19:
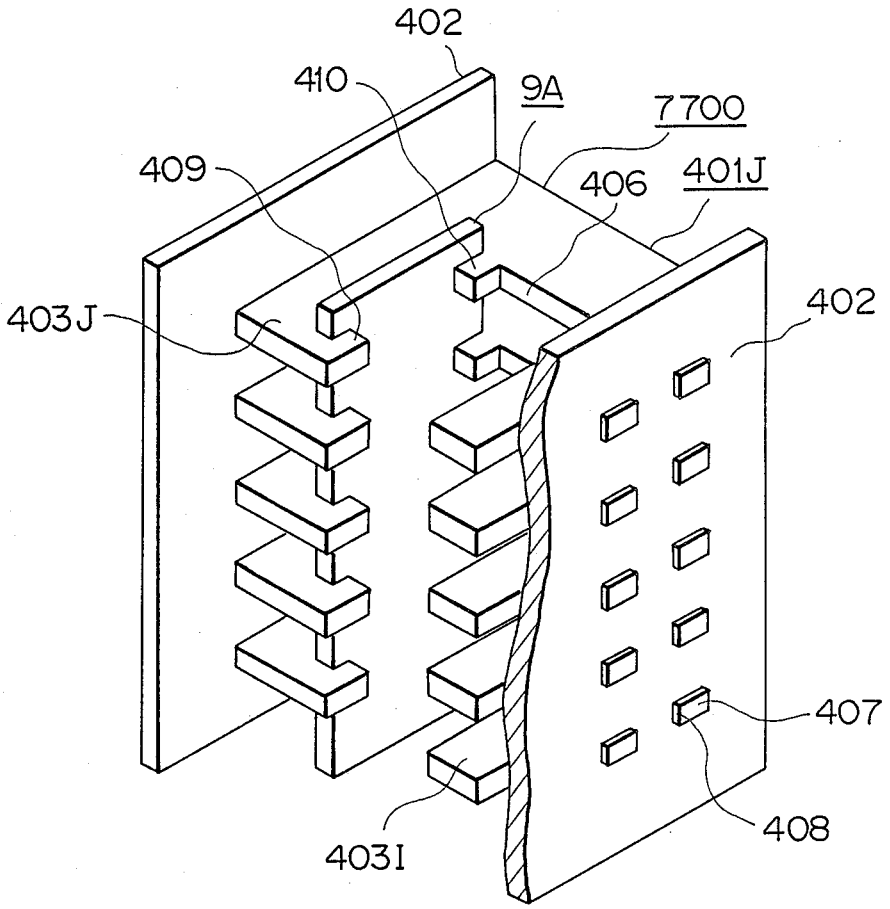
FIG. 19 is a perspective view of an arc extinguishing apparatus 7700 according to a ninth preferred embodiment of the invention.
Figure 20:
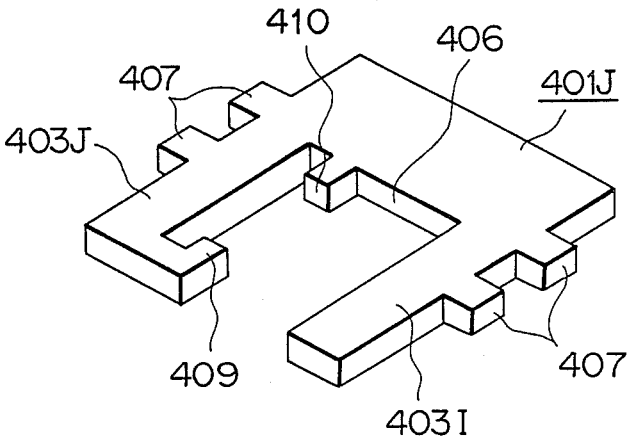
FIG. 20 is a perspective view of the arc extinguishing plate of the arc extinguishing apparatus 7700.

An arc extinguishing apparatus 7700 according to a ninth preferred embodiment of the present invention is shown in FIGS. 19 and 20. FIG. 19 is a perspective view of the arc extinguishing apparatus 7700 and FIG. 20 is a perspective view of an arc extinguishing plate 401J thereof. Referring to the figures, reference numeral 401J denotes an arc extinguishing plate and each arc extinguishing plate 401J is provided inwardly with a first holding portion 409 at the end of the leg portion 403J, on which an insulating plate 9A is to be disposed, forming a space of a predetermined width between the first holding portion 409 and the leg portion 403J. The arc extinguishing plate 401J is also provided inwardly with a second holding portion 410 at the base portion 406 forming a space of the predetermined width between the second holding portion 410 and the leg portion 403J. Thereby, the insulating plate 9A can be inserted between the leg portion 403J and the first and second holding portions 409, 410, and thereafter the first and second holding portions 409, 410 are caulked so that the insulating plate 9A is fixed to the arc extinguishing plates 401J. This ninth preferred embodiment has an advantage over the preceding eighth embodiment in that no holes 901 are needed to be made in the insulating plate 9A. Although the insulating plate 9A in the present embodiment was arranged to be supported by all the arc extinguishing plates 401J, it may be supported by the topmost and the bottommost arc extinguishing plates as same as in the eighth embodiment of FIG. 18.

Figure 21:
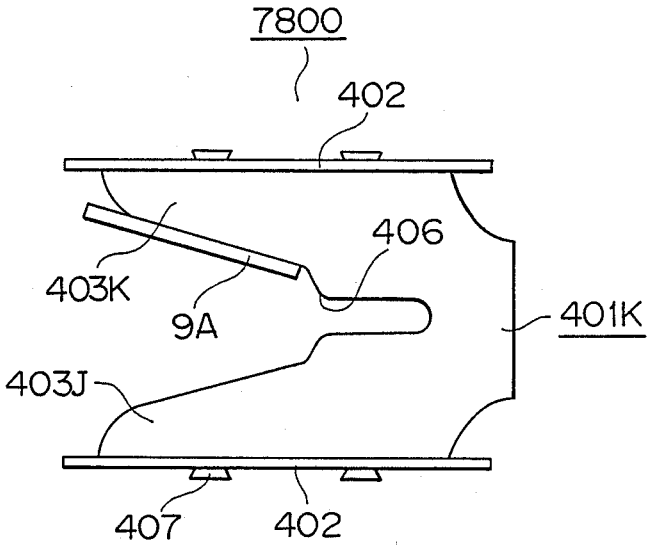
FIG. 21 is a front view of an arc extinguishing apparatus 7800 according to a tenth preferred embodiment.

An arc extinguishing apparatus 7800 according to a tenth preferred embodiment of the present invention is shown as a plan view of FIG. 21. Referring to the figure, reference numeral 401K denotes an arc extinguishing plate. The present arc extinguishing plate 401K is different from the arc extinguishing plates 401, 401H, 401I in the above-described sixth embodiment in that it has two leg portions 403 inner edges thereof are arranged to be oblique by some degree but similar to them in that it is shaped practically in a V-form. The arc extinguishing plate 401K of such a shape is known in the art. In the present embodiment, the insulating plate 9A is attached to the inner surface of the single leg portion 403K of each arc extinguishing plate 401K with a suitable adhesive. Therefore, the leg portion 403K of the arc extinguishing plate 401K is insulated essentially completely from the arc by the insulating plate 9A, whereby the arc is prevented from jumping to the two leg portions 403 practically completely.

An example of the arc extinguishing apparatus 7000 of the above-described present embodiment applied to a three-phase circuit interrupting apparatus 8000 will be shown in FIG. 22 and briefly described in the following.

Figure 22:
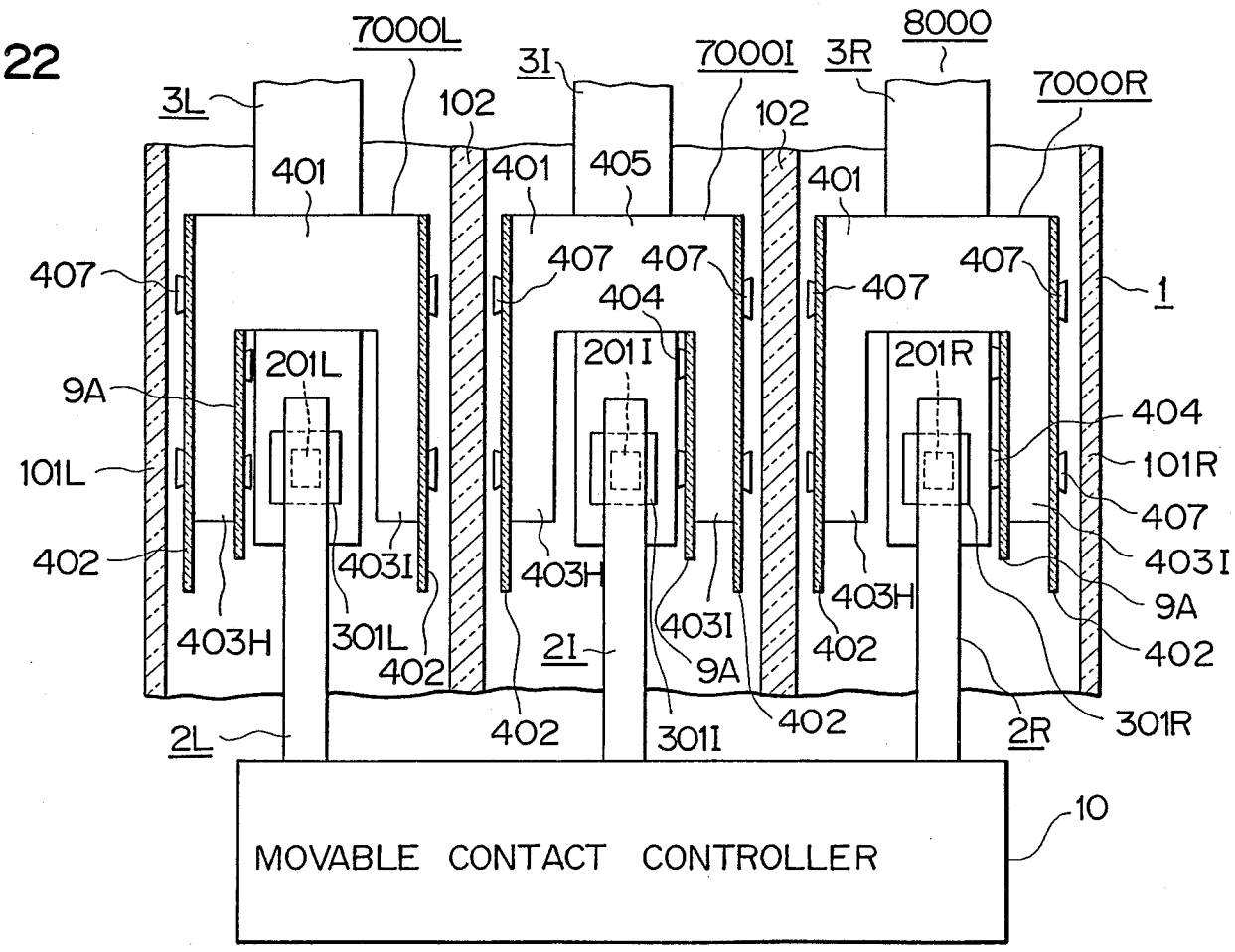
FIG. 22 is a cross-sectional view of a circuit interrupting apparatus 8000 employing the arc extinguishing apparatus 7000L, 7000I, and 7000R shown in FIGS. 13 to 16.

In FIG. 22, arc extinguishing apparatuses 7000L, 7000I, 7000R are disposed in place corresponding to their respective pairs of movable and fixed contacts 201L, 301L; 201I, 301I, 201R, 301R for three phases of the three-phase circuit interrupting apparatus 8000. With such an arrangement, the advantages expected of the above-described single insulating plate 9A can be similarly obtained.

Eleventh Arc Extinguishing Apparatus

A circuit interrupting apparatus 9000 according to an eleventh preferred embodiment of the present invention will be described with reference to FIG. 23.

Figure 23:
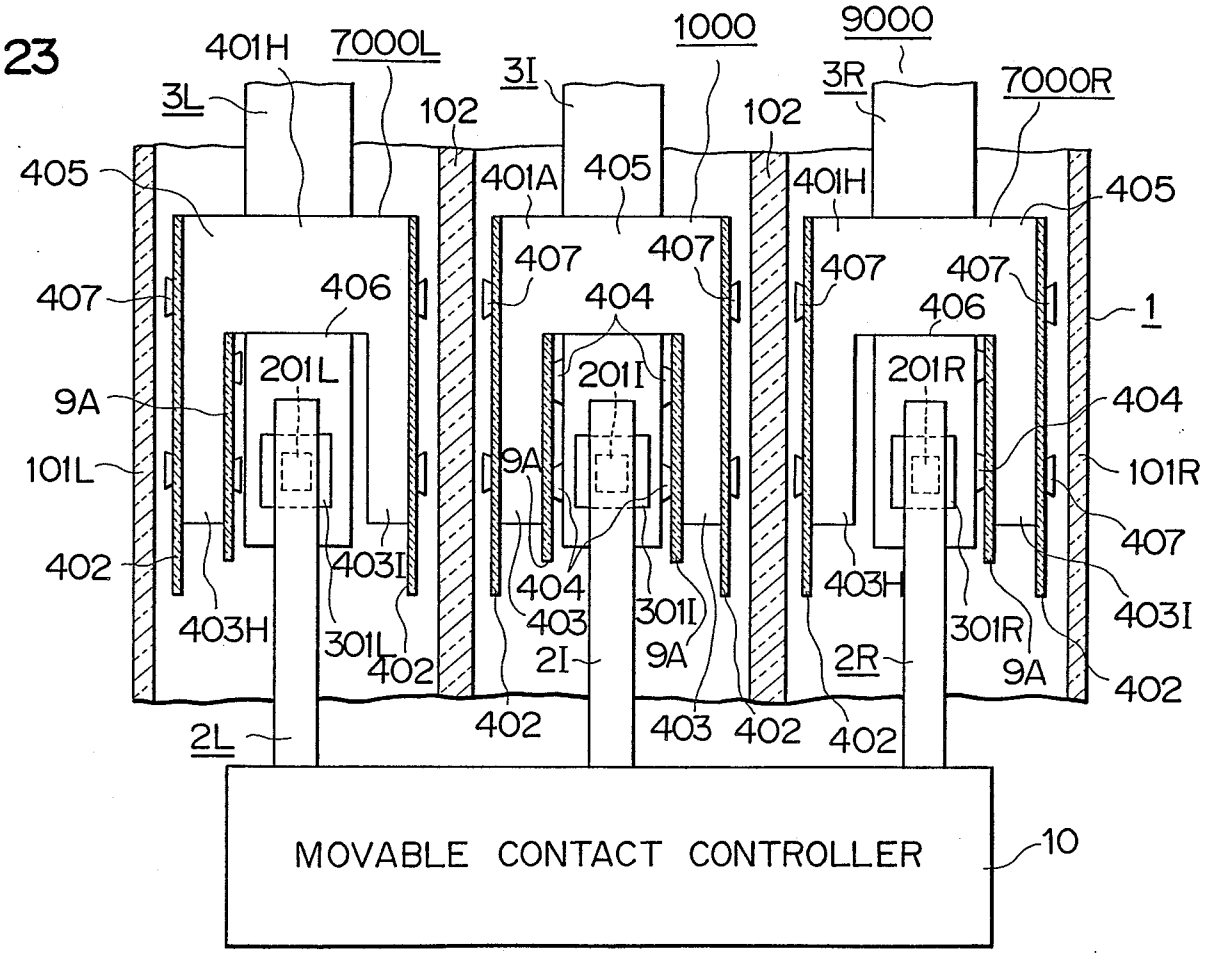
FIG. 23 is a cross-sectional view of a circuit interrupting apparatus 9000 according to an eleventh preferred embodiment of the invention; and, FIG. 24 is a cross-sectional view of a circuit interrupting apparatus 9500 according to a twelfth preferred embodiment of the invention.

As apparent from FIG. 23, in the present circuit interrupting apparatus 9000, the arc extinguishing apparatuses 7000 of the sixth embodiment as shown in FIG. 13 and others are provided for the movable and fixed contacts 201L, 301L and 201R, 301R for the left and right phases (poles) of the arc extinguishing apparatus 9000. Moreover, the arc extinguishing apparatus 1000 of the first embodiment as shown in FIG. 3 and others is provided only for the movable and fixed contacts 201I, 301I for the intermediate phase.

Since the constructions of these arc extinguishing apparatuses 1000, 7000 have already been described in detail, any more description of construction is made here.

Specific Advantages to Circuit Breaker Employing Different Arc Extinguishing Apparatus for all Contacts Now, a description will be given in detail of specific advantages obtained from a three-phase circuit breaker (interrupting apparatus) 9000 employing two different types of arc extinguishing apparatus 1000, 7000 for all of the contacts.

Since the arc extinguishing apparatus 1000 for the movable and fixed contacts 201I, 301I for the intermediate pole (phase) has the insulating plates 9A on both the inner surfaces of the two leg portions 403 of the respective arc extinguishing plates 401, the movable and fixed contacts 201I, 301I for the intermediate pole have a sufficient first-phase interrupting capacity. Therefore, if the contacts 201I, 301I for the intermediate pole are first brought to a zero-cross point during a circuit interrupting period, the contacts for the intermediate pole will make the first-phase interruption, and thereafter, the circuit to be interrupted will constitute a single-phase circuit formed of the contacts 201L, 301L and 201R, 301R for the poles at both sides. As a result, though the arc extinguishing apparatuses 7000L, 7000R provided for the contacts for the poles at both sides have only one insulating plate 9A and therefore they are inferior in the phase interrupting capacity to the arc extinguishing apparatus 1000 having two insulating plates 9A for the intermediate pole, the phase interruption is easily performed by these two pairs of contacts for the poles at both sides, because the two pairs of contacts are only required to interrupt the circuit at the voltage of $\sqrt{3}$ E ("E" being the phase voltage) when the power source is in a Y-connection. In case of a delta-connection, the phase interruption becomes still easier since the two pairs of contacts are only required to interrupt the circuit at the voltage of E. When, on the other hand, the contacts for one of the poles at both ends are first brought to a zero-cross point, if the contacts can perform the first-phase interruption, there is no more problem. Even if it is unable to execute the first-phase interruption, since the first-phase interruption will be performed by the contacts for the intermediate pole when these contacts come to the zero-cross point, the phase interruption is positively performed only causing a delay in the timing of the interruption and there is substantially no problem. To the contrary, when the conventional insulating plates 9A made of an inorganic material are used, it sometimes happens that any of the contact circuits becomes unable to perform the phase interruption even if the insulating plates 9A are fully provided for the arc extinguishing apparatuses 1000, 7000L, 7000R for all the poles.

In addition, since the arc extinguishing apparatuses 7000L, 7000R for the movable and fixed contacts 201L, 301L and 201R, 301R for the poles at both sides each are using only a single insulating plate 9A made of a synthetic resin material, the rise in pressure due to production of the vapor gas from the single insulating plate 9A becomes smaller than that in the region for the intermediate pole. As a result, the pressure difference exerting on the side walls 101L, 101R of the case of the circuit interrupting apparatus becomes rather small, and therefore these side walls 101L, 101R do not receive damage. While some pressure differences exert on the two insulating partitions 102 between the contacts for the poles at both sides and the contacts for the intermediate pole, since some pressure is also build in the arc extinguishing apparatus 7000L, 7000R for the contacts for the poles on both sides due to production of the vapor gas from the single insulating plate 9A used therein, these insulating partition 102 do not receive damage.

It may sometimes occur that the circuit interrupting apparatus 9000 is subjected to vibration, and thereby, the insulating plate 9A and the arc extinguishing plate 401A, 401H come to rub against each other to produce dust of the insulating material. The dust then comes between each of the contacts 201L, 301L; 201I, 301I; and 201R, 301R, and thereby causes worse or insufficient conduction between the pairs of contacts 201L, 301L; 201I, 301I; and 201R, 301R when these are closed. However, by virtue of the arrangement made inthe present eleventh embodiment to have the insulating plate 9A supported by all of the arc extinguishing plates 401A, 401H, it rarely takes place that the insulating plate 9A and the arc extinguishing plates 401A, 401H rub together even when subjected to vibration, and therefore, bad conduction between these pairs of contacts 201L, 301L; 201I, 301I; and 201R, 301R do not occur.

Twelfth Arc Extinguishing Apparatus

Now, a circuit interrupting apparatus 9500 according to a twelfth preferred embodiment as a modification of the circuit interrupting apparatus 9000 of the above described eleventh embodiment will be described with reference to FIG. 24.

Figure 24:
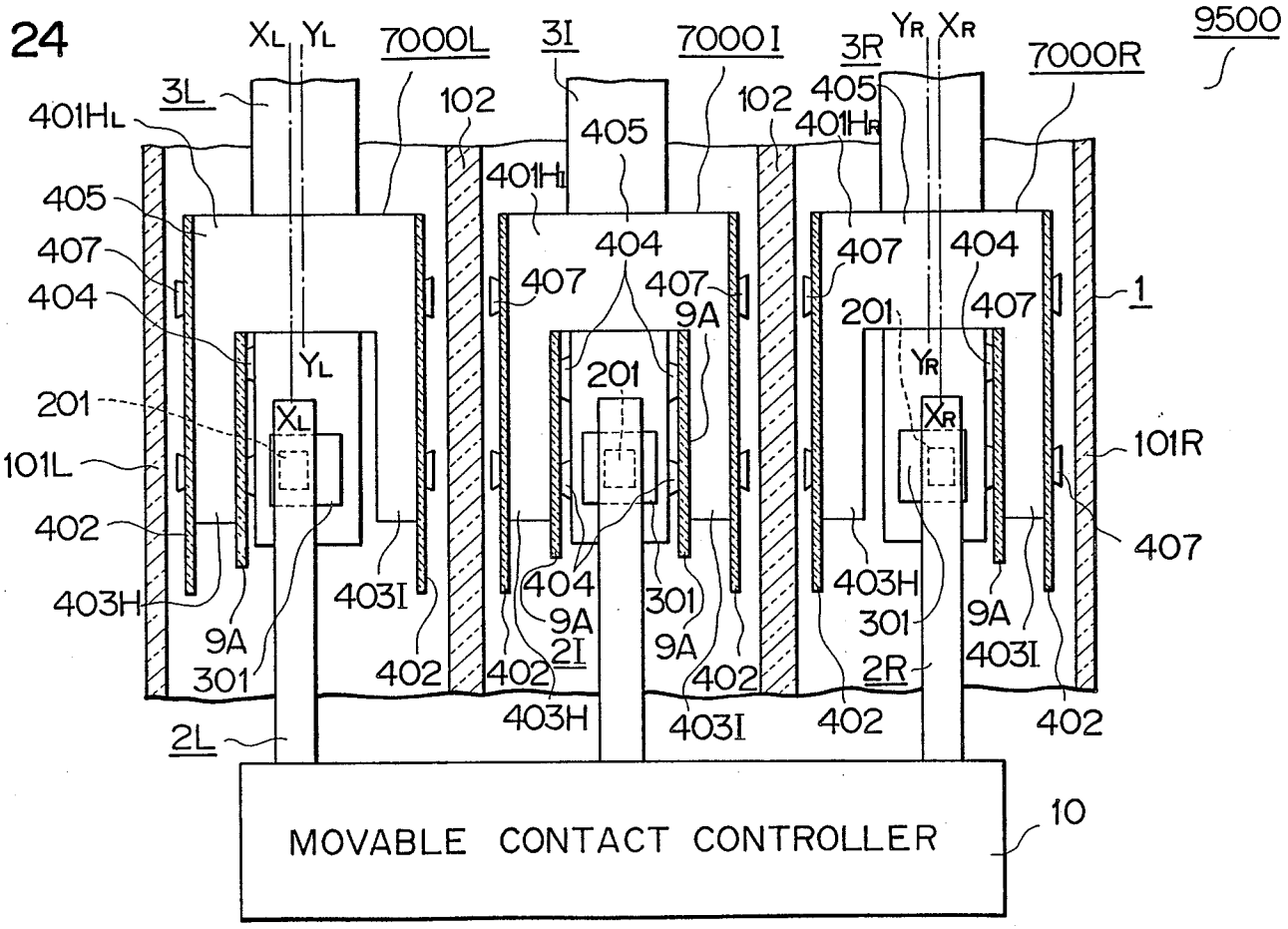

FIG. 24 is a sectional view of the circuit interrupting apparatus 9500 according to the twelfth embodiment. The present embodiment differs from the eleventh embodiment of FIG. 23 in that the center lines $X_{L-XL}$, $X_R$—$X_R$ of the movable contacts 2L, 2R for the poles at both sides are positionally shifted outwardly in horizontal direction in FIG. 24 from the center lines $Y_L$—$Y_L$, $Y_R$—$Y_R$ of the respective arc extinguishing plate 401H$_L$, 401H$_R$ of the corresponding arc extinguishing apparatuses 7000L, 7000R. Moreover, as a preferred arrangement in the present case, the insulating plate 9A is positioned on the inner surfaces of the insulating plate leg portions 403H located closer to the movable contact members 2L, 2R. That is, since the leg portions 403H closer to the movable contact members 2L, 2R are more liable to come in contact with the arc, it is designed to protect, with the insulating plate 9A, the leg portions 403H closer to the side of the movable contact members 2L, 2R in preference to the leg portions 403I positioned far from the fixed contact members 3L, 3R.

Positional Shift of Arc Extinguishing Apparatus

As the case where the center lines $X_L$—$X_L$, $X_R$—$X_R$ of the respective movable contacts 2L, 2R are positionally shifted outwardly in horizontal direction in FIG. 24 with respect to the center lines $Y_L$—$Y_L$, $Y_R$—$Y_R$ of the arc extinguishing plates 401H$_L$, 401H$_R$, namely, the case using a circuit interrupting apparatus 9500 with the internal mechanism (such as the movable contact controller 10) standardized and the size of the case 1 of the circuit interrupting apparatus adapted to be the size corresponding to its rated current. For instance, the center lines $X_L$—$X_L$, $X_R$—$X_R$ of the movable contacts 2L, 2R for the poles at both sides are coincident with the center lines $Y_L$—$Y_L$, $Y_R$—$Y_R$ of the arc extinguishing plates 401H$_L$, 401H$_R$ in a circuit interrupting apparatus for 600 A (Amperes). However, if it is attempted to put an internal mechanism being the same as that for 600 A into a case of a circuit interrupting apparatus for 400 A, since the case of the 400 A circuit interrupting apparatus is smaller than that for 600 A, the arc extinguishing apparatuses 7000L, 7000R together with the fixed contact members 3L, 3R will have to be positionally shifted toward the intermediate pole relative to the movable contact members 2L, 2R. Consequently, the center lines $X_L$—$X_L$, $X_R$—$X_R$ come to be positionally shifted outwardly of the center lines $Y_L$—$Y_L$, $Y_R$—$Y_R$. Moreover, if both side walls 101L, 101R are made thicker without changing the external size of the case of the circuit interrupting apparatus for such purpose so as to improve mechanical strength, since generally the identical fixed contact members 3L, 3R are used and the pitch between the fixed contact members 3L, 3R are kept unchanged, the movable contact members 2L, 2R and the arc extinguishing apparatuses 7000L, 7000R for the poles at both sides are required to be positionally shifted toward the intermediate pole. Therefore, the center lines of the fixed contact members 3L, 3R come to be shifted outwardly inthe horizontal direction relative to the center lines $Y_L$—$Y_L$, $Y_R$—$Y_R$ of the arc extinguishing plates 401H$_L$, 401H$_R$. Thus, also in this case, the insulating plates 9A must be disposed on the interior of the leg portions 403H on the same sides as in the twelfth embodiment of FIG. 24. Furthermore, when, for some reason or others, the center lines $X_L$—$X_L$, $X_R$—$X_R$ of the movable contact members 2L, 2R and/or the center lines of the fixed contact members 3L, 3R are positionally shifted toward the intermediate pole relative to the center lines of the arc extinguishing plates 401H, the same results will be obtained by positioning the insulating plates 9A on the inner surfaces of the arc extinguishing plate leg portions 403I on the opposite sides to those in the above-described twelfth preferred embodiment of FIG. 24.

Many modifications of the present invention may be apparently possible without departing from the technical scope of the invention. For example, the above-described various types of the insulating materials may be used in this twelfth embodiment are extinguishing apparatus.

According to the present embodiment as described above, the following particular advantages may be obtained by employing such a simple construction as to position the insulating plates made of a synthetic resin material on the inner surfaces of the two leg portions of the arc insulating plates for the arc extinguishing apparatus for each of the intermediate poles and also to position a similar insulating plate on the inner surface of one of the two leg portions of the arc extinguishing plates for the arc extinguishing apparatus for each of the poles at both sides. That is, it is possible to realize multi-pole circuit interrupting apparatuses for three poles or above exhibiting better circuit interrupting performance than those employing the conventional insulating plates made of an inorganic material and causing no serious damage on the case of the circuit interrupting apparatus even if the vapor gas is produced from the insulating plate made of such a synthetic resin material when exposed to heat of the arc produced during the circuit interruption.

While the present invention has been described in detail, the features of the invention will now be again summarized.

The arc extinguishing apparatus according to the present invention is characterized by that the insulating plates made of a synthetic resin material are positioned on the inner surfaces of both of the two leg portions of the respective arc extinguishing plates.

The multi-pole (multi-phase) circuit interrupting apparatus according to the present invention is characterized by that the insulating plates made of a synthetic resin material, for the arc extinguishing apparatus provided for a pair of contacts for each pole, are positioned on the inner surfaces of both of the two leg portions of the arc extinguishing plates for the arc extinguishing apparatus only for the contacts for the intermediate poles, not for the respective contacts for the poles at both ends.

The arc extinguishing apparatus according to the present invention is featured by that the insulating plate made of a synthetic resin material is positioned on the inner surface of only one of the two leg portions of the respective arc extinguishing plates.

In addition, the multi-pole circuit interrupting apparatus according to the present invention is characterized by that, the arc extinguishing apparatuses having the insulating plates made of a synthetic resin material positioned on the inner surface of one of the two leg portions of its arc extinguishing plates are provided for the pairs of contacts for the respective poles at both ends, whereas the arc extinguishing apparatuses having the insulating plates made of a synthetic resin material arranged on the inner surfaces of both of the two leg portions of its arc extinguishing plates are provided for the pairs of contacts for the intermediate poles, other than the pairs of contacts for the respective poles at both ends.

What is claimed is:

1. An arc extinguishing apparatus used for extinguishing an arc produced between a pair of switchable contact members of a circuit interrupting apparatus, comprising:

a plurality of arc extinguishing plates made of a metal material, each arc extinguishing plate being constructed of one base portion and two leg portions positioned opposite to each other, and said plurality of arc extinguishing plates being stacked up at a predetermined interval; and, a pair of insulating plates made of a synthetic resin, positioned on both inside surfaces of the leg portions of the respective stacked arc extinguishing plates so as to define a space where said paired switchable contact members of the circuit interrupting apparatus are located.

2. An arc extinguishing apparatus as claimed in claim 1, wherein each of said arc extinguishing plates is a substantially U-shaped form.

3. An arc extinguishing apparatus as claimed in claim 1, wherein each of said arc extinguishing plates is a substantially V-shaped form.

4. An arc extinguishing apparatus as claimed in claim 2, wherein at least one projection is formed on both said respective inside surfaces of the leg portions of each arc extinguishing plate; and, at least one hole is formed in each of said insulating plates so as to caulk said corresponding projection of each of the leg portions therein.

5. An arc extinguishing apparatus as claimed in claim 2, wherein at least one projection is formed on both said respective inside surfaces of the leg portions of the respective arc extinguishing plates positioned at both uppermost and lowermost positions under the stacked condition of the arc extinguishing plates, and at least one hole is formed in each of said insulating plates so as to caulk said corresponding projection of each of the leg portions therein.

6. An arc extinguishing apparatus as claimed in claim 2, wherein two pairs of holding portions are formed on both said respective inside surfaces of each of the U-shaped arc extinguishing plates so as to hold said insulating plates by each pair of holding portions.

7. A circuit interrupting apparatus comprising:

at least first, second, and third poles located in parallel with each other, each pole being constructed of a pair of switchable contact members; and at least first, second, and third arc extinguishing apparatus mounted on said corresponding first, second, and third poles, for extinguishing an arc produced between said pair of switchable contact members of each pole- each of said arc extinguishing apparatus including:

a plurality of arc extinguishing plates made of a metal material, each arc extinguishing plate being constructed of one base portion and two leg portions positioned opposite to each other, and said plurality of arc extinguishing plates being stacked up at a predetermined interval; and, a pair of insulating plates made of a synthetic resin, positioned on both inside surfaces of the leg portions of the respective stacked arc extinguishing plates so as to define a space where said paired switchable contact members of the circuit interrupting apparatus are located.

8. A circuit interrupting apparatus comprising:

first and second poles located in parallel with each other, each pole being constructed of a pair of switchable contact members;

at least a third pole positioned between said first and second poles and constructed of a pair of switchable contact members; and an arc extinguishing apparatus mounted on said third pole, for extinguishing an arc produced between said pair of switchable contact members of the third pole, said arc extinguishing apparatus including:

a plurality of arc extinguishing plates made of a metal material, each arc extinguishing plate being constructed of one base portion and two leg portions positioned opposite to each other, and said plurality of arc extinguishing plates being stacked up at a predetermined interval; and, a pair of insulating plates made of a synthetic resin, positioned on both inside surfaces of the leg portions of the respective stacked arc extinguishing plates so as to define a space where said switchable contact members of the circuit interrupting apparatus are located.

9. An arc extinguishing apparatus as claimed in claim 1, wherein said insulating plates are made of a silicone resin as a thermoset resin.

10. An arc extinguishing apparatus as claimed in claim 1, wherein said insulating plates are made of a saturated polyester resin as a thermoplastic resin.

11. An arc extinguishing apparatus as claimed in claim 1, wherein said insulating plates are made of an unsaturated polyester resin as a thermoset resin.

12. An arc extinguishing apparatus as claimed in claim 1, wherein said insulating plates are made of an epoxy resin as a thermoset resin.

13. An arc extinguishing apparatus as claimed in claim 1, wherein said insulating plates are made of a phenolic resin as a thermoset resin.

14. An arc extinguishing apparatus as claimed in claim 1, wherein said insulating plates are made of a thermoplastic resin manufactured by mixing a saturated polyester resin with a glass fiber.

15. An arc extinguishing apparatus as claimed in claim 1, wherein said insulating plates are made of a thermoset resin manufactured by mixing an unsaturated polyester resin with a glass fiber.

16. An arc extinguishing apparatus as claimed in claim 1, wherein said insulating plates are made of a thermoset resin manufactured by mixing a phenolic resin with a glass fiber.

17. An arc extinguishing apparatus as claimed in claim 1, wherein said insulating plates are made of a fiber sheet.

18. An arc extinguishing apparatus, as claimed in claim 1, wherein a synthetic resin of said insulating plates is selected from one of the groups of polybutylene terephthalate (PBT), polyethylene terephthalate (PET), and polyamide.

19. An arc extinguishing apparatus as claimed in claim 3, wherein said pair of insulating plates are fixed on both said inside surfaces of the leg portions of the stacked arc extinguishing plates by an adhesive.

20. An arc extinguishing apparatus used for extinguishing an arc produced between a pair of switchable contact members of a circuit interrupting apparatus, comprising:

a plurality of arc extinguishing plates made of a metal material, each arc extinguishing plate being constructed of one base portion and two leg portions positioned opposite to each other, and said plurality of arc extinguishing plates being stacked up at a predetermined interval; and, one insulating plate made of a synthetic resin, positioned on both inside surface of the leg portions of the respective stacked arc extinguishing plates so as to define a space where said paired switchable contact members of the circuit interrupting apparatus are located.

21. An arc extinguishing apparatus as claimed in claim 20, wherein said arc extinguishing plate is a substantially U-shaped form.

22. An arc extinguishing apparatus as claimed in claim 20, wherein said arc extinguishing plate is a substantially V-shaped form.

23. An arc extinguishing apparatus as claimed in claim 21, wherein at least one projection is formed on said inside surface of one of the leg portions of each arc extinguishing plate; and, at least one hole is formed in said one insulating plate so as to caulk said corresponding projection of each of the leg portions therein.

24. An arc extinguishing apparatus as claimed in claim 21, wherein at least one projection is formed on said inside surface of one of the leg portions of the respective arc extinguishing plates positioned at both uppermost and lowermost positions under the stacked condition of the arc extinguishing plates, and at least one hole is formed in said insulating plate so as to caulk aid corresponding projection of each of the leg portions therein.

25. An arc extinguishing apparatus as claimed in claim 21, wherein two pairs of holding portions are formed on said inside surface of each of the U-shaped arc extinguishing plates so as to hold said insulating plates by each pair of holding portions.

26. A circuit interrupting apparatus comprising:

at least first, second, and third poles located in parallel with each other, each pole being constructed of a pair of switchable contact members; and at least first, second, and third arc extinguishing apparatus mounted on said corresponding first, second, and third poles, for extinguishing an arc produced between said pair of switchable contact members of each pole, each of said arc extinguishing apparatus including:

a plurality of arc extinguishing plates made of a metal material, each arc extinguishing plate being constructed of one base portion and two leg portions positioned opposite to each other, and said plurality of arc extinguishing plates being stacked up at a predetermined interval; and, one insulating plate made of a synthetic resin, positioned on an inside surface of one of said leg portions of the respective stacked arc extinguishing plates so as to define a space where said paired switchable contact members of the circuit interrupting apparatus by said one insulating plate.

27. A circuit interrupting apparatus comprising:

at least first and second poles positioned in parallel with each other, each pole being constructed of a pair of switchable contact members, and at least first and second arc extinguishing apparatus mounted on said corresponding first and second poles, for extinguishing an arc produced between said pair of switchable contact members of the respective poles, each of said arc extinguishing apparatus including:

a plurality of arc extinguishing plates made of a metal material, each arc extinguishing plate being constructed of one base portion and two leg portions positioned opposite to each other, and said plurality of arc extinguishing plates being stacked up at a predetermined interval; and, one insulating plate made of a synthetic resin, positioned on an inside surface of one of said leg portions of the respective stacked arc extinguishing plates so as to define a space where said paired switchable contact members of the circuit interrupting apparatus are positioned closer to said insulating plate.

28. An arc extinguishing apparatus as claimed in claim 20, wherein said insulating plates are made of a silicone resin as a thermoset resin.

29. An arc extinguishing apparatus as claimed in claim 20, wherein said insulating plates are made of a saturated polyester resin as a thermoplastic resin.

30. An arc extinguishing apparatus as claimed in claim 20, wherein said insulating plates are made of an unsaturated polyester resin as a thermoset resin.

31. An arc extinguishing apparatus as claimed in claim 20, wherein said insulating plates are made of an epoxy resin as a thermoset resin.

32. An arc extinguishing apparatus as claimed in claim 20, wherein said insulating plates are made of a phenolic resin as a thermoset resin.

33. An arc extinguishing apparatus as claimed in claim 20, wherein said insulating plates are made of a thermoplastic resin manufactured by mixing a saturated polyester resin with a glass fiber.

34. An arc extinguishing apparatus as claimed in claim 20, wherein said insulating plates are made of a thermoset resin manufactured by mixing an unsaturated polyester resin with a glass fiber.

35. An arc extinguishing apparatus as claimed in claim 20, wherein said insulating plates are made of a thermoset resin manufactured by mixing a phenolic resin with a glass fiber.

36. An arc extinguishing apparatus as claimed in claim 20, wherein said insulating plates are made of a fiber sheet.

37. An arc extinguishing apparatus, as claimed in claim 20, wherein a synthetic resin of said insulating plates is selected from one of the groups of polybutylene terephthalate (PBT), polyethylene terephthalate (PET), and polyamide.

38. An arc extinguishing apparatus as claimed in claim 22, wherein said one insulating plate is fixed on said inside surface of one of the leg portions of the stacked arc extinguishing plates by an adhesive.

39. A circuit interrupting apparatus comprising:

at least first, second, and third poles located in parallel with each other, each pole being constructed of a pair of switchable contact members and said second pole being located between said first and third poles; and, at least first, second, and third arc extinguishing apparatus mounted on said corresponding first, second, and third poles, for extinguishing an arc between said pair of switchable contact members of each pole, said first and third arc extinguishing apparatus each including:

a plurality of arc extinguishing plates made of a metal material, each arc extinguishing plate being constructed of one base portion and two leg portions positioned opposite to each other, and said plurality of arc extinguishing plates being stacked up at a predetermined interval; and, one insulating plate made of a synthetic resin, positioned on an inside surface of one of said leg portions of the respective stacked arc extinguishing plates so as to define a space where said paired switchable contact members of the circuit interrupting apparatus are located, and also said second arc extinguishing apparatus positioned between said first and third arc extinguishing apparatus, including:

a plurality of arc extinguishing plates made of a metal material, each arc extinguishing plate being constructed of one base portion and two leg portions positioned opposite to each other, and said plurality of arc extinguishing plates being stacked up at a predetermined interval; and, a pair of insulating plates made of a synthetic resin, positioned on both inside surfaces of the leg portions of the respective stacked arc extinguishing plates so as to define a space where said paired switchable contact members of the circuit interrupting apparatus are located.

40. A circuit interrupting apparatus as claimed in claim 39, wherein said first and third arc extinguishing apparatus are mounted on said corresponding first and third poles under the condition that said paired switchable contact members of the circuit interrupting apparatus are positioned closer to said one insulating plate.

* * * * *